US007681606B2

(12) United States Patent
Khan et al.

(10) Patent No.: US 7,681,606 B2
(45) Date of Patent: Mar. 23, 2010

(54) AUTOMATED SYSTEM AND PROCESS FOR FILLING DRUG DELIVERY DEVICES OF MULTIPLE SIZES

(75) Inventors: Abdul Wahid Khan, Lindenhurst, IL (US); Joel A. Osborne, Port Orange, FL (US); Dennis Tribble, Ormond Beach, FL (US)

(73) Assignee: FHT, Inc., Englewood, CO (US)

( * ) Notice: Subject to any disclaimer, the term of this patent is extended or adjusted under 35 U.S.C. 154(b) by 20 days.

(21) Appl. No.: 11/765,093

(22) Filed: Jun. 19, 2007

(65) Prior Publication Data

US 2008/0035234 A1 Feb. 14, 2008

Related U.S. Application Data

(60) Provisional application No. 60/822,037, filed on Aug. 10, 2006.

(51) Int. Cl.
*B65B 43/42* (2006.01)

(52) U.S. Cl. ..... 141/147; 141/144; 141/145

(58) Field of Classification Search ..... 141/2, 141/18, 21–27, 94, 100, 104, 144–147; 604/407, 604/411, 416

See application file for complete search history.

(56) References Cited

U.S. PATENT DOCUMENTS

| | | | |
|---|---|---|---|
| 2,880,723 | A | 4/1959 | Adams |
| 2,981,432 | A | 4/1961 | Flood |
| 2,988,984 | A | 6/1961 | Eckert |
| 3,200,486 | A | 8/1965 | Shields |
| 3,527,017 | A | 9/1970 | Tayler et al. |
| 3,736,933 | A | 6/1973 | Szabo |
| 3,823,818 | A | 7/1974 | Shaw |
| 3,835,897 | A | 9/1974 | Gess |
| 3,848,485 | A | 11/1974 | Grenci |
| 3,865,236 | A | 2/1975 | Rycroft |
| 3,880,211 | A | 4/1975 | Gess |
| 3,965,945 | A | 6/1976 | Ross |
| 4,058,121 | A | 11/1977 | Choksi et al. |
| 4,472,357 | A | 9/1984 | Levy et al. |
| 4,502,616 | A | 3/1985 | Meierhoefer |
| 4,512,475 | A | 4/1985 | Federighi et al. |
| 4,624,148 | A | 11/1986 | Averette |
| 4,639,250 | A | 1/1987 | Rycroft |
| 4,674,652 | A | 6/1987 | Aten et al. |
| 4,699,186 | A | 10/1987 | Palin et al. |
| 4,758,230 | A | 7/1988 | Rycroft |

(Continued)

OTHER PUBLICATIONS

U.S. Appl. No. 11/466,354 (Related Application), Osborne et al.

(Continued)

*Primary Examiner*—Timothy L Maust
(74) *Attorney, Agent, or Firm*—Leason Ellis LLP

(57) ABSTRACT

In one exemplary embodiment, an automated medication preparation system according to the present invention includes automated preparation of a dosage of medication in a drug delivery devices, such as a syringe, and includes an automated transport device for controllably delivering each drug delivery device from one location to another location and a receiving member that is associated with the automated transport device and includes at least two pockets for receiving and retaining at least two differently sized drug delivery devices according to a predetermined orientation. The system also includes a controller in communication with the automated transport device for moving the automated transport device in an indexed manner.

15 Claims, 7 Drawing Sheets

U.S. PATENT DOCUMENTS

| | | | |
|---|---|---|---|
| 4,773,285 | A | 9/1988 | Dionne et al. |
| 4,861,335 | A | 8/1989 | Reynolds et al. |
| 4,865,592 | A | 9/1989 | Rycroft |
| 4,944,736 | A | 7/1990 | Holtz |
| 5,004,962 | A | 4/1991 | Fonss et al. |
| 5,040,437 | A | 8/1991 | Mueller |
| 5,229,074 | A | 7/1993 | Heath et al. |
| 5,256,154 | A | 10/1993 | Liebert et al. |
| 5,288,285 | A | 2/1994 | Carter |
| 5,341,854 | A | 8/1994 | Zezulka et al. |
| 5,356,393 | A | 10/1994 | Haber et al. |
| 5,363,885 | A | 11/1994 | McConnell et al. |
| 5,431,201 | A | 7/1995 | Torchia et al. |
| 5,451,528 | A | 9/1995 | Raymoure et al. |
| 5,479,969 | A | 1/1996 | Hardie et al. |
| 5,496,288 | A | 3/1996 | Sweeney |
| 5,542,935 | A | 8/1996 | Unger et al. |
| 5,597,530 | A | 1/1997 | Smith et al. |
| 5,651,775 | A | 7/1997 | Walker et al. |
| 5,669,599 | A | 9/1997 | Toh et al. |
| 5,704,921 | A | 1/1998 | Carilli |
| 5,735,181 | A | 4/1998 | Anderson |
| 5,769,086 | A | 6/1998 | Ritchart et al. |
| 5,805,454 | A | 9/1998 | Valerino, Sr. et al. |
| 5,826,409 | A | 10/1998 | Slepicka et al. |
| 5,855,839 | A | 1/1999 | Brunel et al. |
| 5,884,457 | A | 3/1999 | Ortiz et al. |
| 5,899,889 | A | 5/1999 | Futagawa et al. |
| 5,911,252 | A | 6/1999 | Cassel |
| 5,948,360 | A | 9/1999 | Rao et al. |
| 6,027,472 | A | 2/2000 | Kriesel et al. |
| 6,048,086 | A | 4/2000 | Valerino |
| 6,068,614 | A | 5/2000 | Kimber et al. |
| 6,142,039 | A | 11/2000 | Herring, Sr. |
| 6,200,289 | B1 | 3/2001 | Hochman et al. |
| 6,343,690 | B1 | 2/2002 | Britton et al. |
| 6,360,794 | B1 | 3/2002 | Turner |
| 6,599,476 | B1 | 7/2003 | Watson et al. |
| 6,623,455 | B2 | 9/2003 | Small et al. |
| 6,813,868 | B2 | 11/2004 | Baldwin et al. |
| 6,915,823 | B2 | 7/2005 | Osborne et al. |
| 2001/0018937 | A1 | 9/2001 | Nemoto |
| 2002/0198738 | A1 | 12/2002 | Osborne |
| 2004/0250842 | A1 | 12/2004 | Adams et al. |
| 2005/0252572 | A1 | 11/2005 | Khan et al. |
| 2005/0252574 | A1 | 11/2005 | Khan et al. |
| 2006/0178578 | A1 | 8/2006 | Tribble et al. |
| 2006/0201575 | A1 | 9/2006 | Osborne |

OTHER PUBLICATIONS

U.S. Appl. No. 11/551,608 (Related Application), Osborne et al.
U.S. Appl. No. 11/551,574 (Related Application), Tribble et al.
U.S. Appl. No. 11/551,555 (Related Application), Bender et al.
U.S. Appl. No. 11/554,677 (Related Application), Tribble et al.

AUTOMATED SYSTEM AND PROCESS FOR FILLING DRUG DELIVERY DEVICES OF MULTIPLE SIZES

CROSS REFERENCE TO PRIOR APPLICATION

This application claims priority to U.S. Provisional Application No. 60/822,037 filed on Aug. 10, 2006, which is incorporated by reference herein in its entirety.

TECHNICAL FIELD

The present invention relates generally to medical and pharmaceutical equipment, and more particularly, to an automated system for preparing drug preparations and in particular, to an automated system that can handle and process drug delivery devices, such as syringes, of multiple sizes.

BACKGROUND

Drug delivery devices are used in a number of different applications and settings. One type of drug delivery device that is commonly used in a medical or pharmaceutical setting is a disposable syringe. Disposable syringes are in widespread use for a number of different types of applications. For example, syringes are used not only to withdraw a fluid (e.g., blood) from a patient but also to administer a medication to a patient. In the latter, a cap or the like is removed from the syringe and a unit dose of the medication is carefully measured and then injected or otherwise disposed within the syringe.

As technology advances, more and more sophisticated, automated systems are being developed for preparing and delivering medications by integrating a number of different stations, with one or more specific tasks being performed at each station. For example, one type of exemplary automated system operates as a syringe filling apparatus that receives user inputted information, such as the type of medication, the volume of the medication and any mixing instructions, etc. The system then uses this inputted information to disperse the correct medication into the syringe up to the inputted volume.

In some instances, the medication that is to be delivered to the patient includes more than one pharmaceutical substance. For example, the medication can be a mixture of several components, such as several pharmaceutical substances.

By automating the medication preparation process, increased production and efficiency are achieved. This results in reduced production costs and also permits the system to operate over any time period of a given day with only limited operator intervention for manual inspection to ensure proper operation is being achieved. Such a system finds particular utility in settings, such as large hospitals, including a large number of doses of medications that must be prepared daily. Traditionally, these doses have been prepared manually in what is an exacting but tedious responsibility for a highly skilled staff. In order to be valuable, automated systems must maintain the exacting standards set by medical regulatory organizations, while at the same time simplifying the overall process and reducing the time necessary for preparing the medications.

Because syringes are used often as the carrier means for transporting and delivering the medication to the patient, it is advantageous for these automated systems to be tailored to accept syringes. However, the previous methods of dispersing the medication from the vial and into the syringe were very time consuming and labor intensive. More specifically, medications and the like are typically stored in a vial that is sealed with a safety cap or the like. In conventional medication preparation, a trained person retrieves the correct vial from a storage cabinet or the like, confirms the contents and then removes the safety cap manually. This is typically done by simply popping the safety cap off with one's hands. Once the safety cap is removed, the trained person inspects the integrity of the membrane and cleans the membrane. An instrument, e.g., a needle, is then used to pierce the membrane and withdraw the medication contained in the vial. The withdrawn medication is then placed into a syringe to permit subsequent administration of the medication from the syringe.

Typically, a drug is provided off the shelf in solid form within an injectable drug vial that is initially stored in a drug cabinet or the like. To prepare an injectable unit dose of medication, a prescribed amount of diluent (water or some other liquid) is added to the vial to cause the solid drug to go completely into solution. Mixing and agitation of the vial contents is usually required. This can be a time consuming and labor intensive operation since first it must be determined how much diluent to add to achieve the desired concentration of medication and then this precise amount needs to be added and then the vial contents need to be mixed for a predetermined time period to ensure that all of the solid goes into solution. Thus, there is room for human error in that the incorrect amount of diluent may be added, thereby producing medication that has a concentration that is higher or lower than it should be. This can potentially place the patient at risk and furthermore, the reconstitution process can be very labor intensive since it can entail preparing a considerable number of medication syringes that all can have different medication formulations. This can also lead to confusion and possibly human error.

If the medication needs to be reconstituted, the medication initially comes in a solid form and is contained in an injectable drug vial and then the proper amount of diluent is added and the vial is agitated to ensure that all of the solid goes into solution, thereby providing a medication having the desired concentration. The drug vial is typically stored in a drug cabinet or the like and is then delivered to other stations where it is processed to receive the diluent.

Automated systems are typically configured to accept and operate with only single sized syringes and therefore, multiple devices are required when it is desired to fill syringes of different sizes since the systems are specific to one syringe size. It would therefore be advantageous if a single medication preparation system is configured to receive and handle syringes of multiple sizes.

SUMMARY

In one exemplary embodiment of the present invention, an automated medication preparation system includes automated preparation of a dosage of medication in a drug delivery device and includes an automated transport device for controllably delivering each drug delivery device, such as a syringe, from one location to another location. The system also includes a drug delivery device receiving/retaining member that is associated with the automated transport device and includes pockets for receiving and retaining two or more differently sized drug delivery devices according to a predetermined orientation. The system also includes a controller in communication with the automated transport device for moving the automated transport device in an indexed manner.

In another aspect, an automated medication preparation system according to the present invention includes automated syringe preparation for preparing a dosage of medication and includes an automated transport device for controllably delivering each syringe from one location to another location and a syringe block that is associated with the automated transport device and includes pockets for receiving and retaining two or more differently sized syringes according to a predetermined orientation such that a distance from a center of each syringe to a center of the transport device is at least approximately equal and distal tips of the syringes are contained in the same horizontal plane. The system of the present invention is a controller in communication with the automated transport device for moving the automated transport according to a first indexing movement and a different second indexing movement. The first indexing movement causes one syringe block to be moved from one station to another station, while the second indexing movement is a partial indexing movement within the syringe block for making incremental syringe size adjustments at one select station so at to position one of the pockets at a target location to permit an operation to be performed on the respective syringe at the one station.

In yet another aspect of the present invention, a method is provided for handling a plurality of drug delivery devices having multiple sizes in an automated system for preparation of individual dosages of medication by means of a fluid transfer device. The method includes the steps of providing a transport device for moving the drug delivery devices from one location to another location; associating a syringe block with the transport device, wherein the syringe block has a plurality of pockets for receiving and retaining two or more differently sized syringes; receiving and orientating the syringes in the respective pockets such that a distance from a center of each syringe to a center of the transport device is at least approximately equal and distal tips of the syringes are contained in the same horizontal plane; and moving the automated transport according to a first indexing movement and a different second indexing movement, wherein the first indexing movement causes one syringe block to be moved from one station to another station, while the second indexing movement is a partial indexing movement within the syringe block for making incremental syringe size adjustments at one select station so as to position one of the pockets at a target location to permit an operation to be performed on the respective syringe at the one station.

Further aspects and features of the exemplary automated system and method disclosed herein can be appreciated from the appended Figures and accompanying written description.

BRIEF DESCRIPTION OF THE DRAWING FIGURES

FIG. 1 is a diagrammatic plan view of one exemplary automated system for preparing a medication to be administered to a patient and includes an indexing transport device for controllably moving the drug delivery devices, such as syringes, from one location (station) to another location (station) and that includes one or more blocks that are each constructed to accommodate drug delivery devices of various sizes according to the present invention;

DETAILED DESCRIPTION OF PREFERRED EMBODIMENTS

Figure 1:
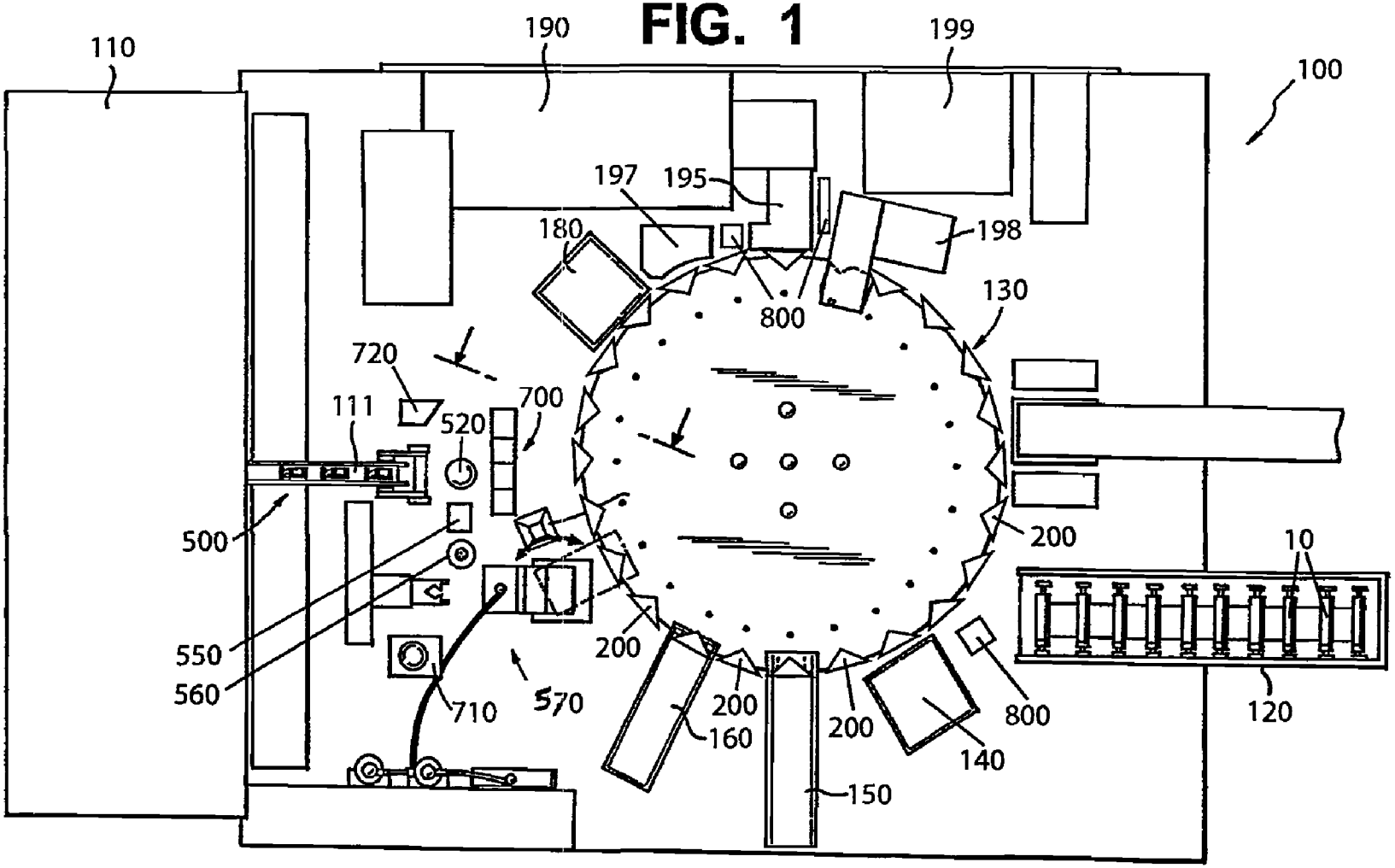

FIG. 1 is a schematic diagram illustrating one exemplary automated system, generally indicated at 100, for the preparation of a medication. The automated system 100 is divided into a number of stations where a specific task is performed based on the automated system 100 receiving user input instructions, processing these instructions and then preparing unit doses of one or more medications in accordance with the instructions. The automated system 100 includes a station 110 where medications and other substances used in the preparation process are stored. As used herein, the term "medication" refers to a medicinal preparation for administration to a patient. Often, the medication is initially stored as a solid, e.g., a powder, to which a diluent is added to form a medicinal composition. Thus, the station 110 functions as a storage unit for storing one or more medications, etc., under proper storage conditions. Typically, medications and the like are stored in sealed containers, such as vials, that are labeled to clearly indicate the contents of each vial.

A first station 120 is a station where medication (drug) delivery devices 10 are stored and in particular, the drug delivery devices 10 can take any number of different forms, with some of the more common forms being a syringe, an IV bag, a drug package, a container, etc. For purpose of illustration, the drug delivery device 10 is shown and described as being a syringe; however, this is merely one exemplary type of drug delivery device 10 and is not limiting of the scope of the present invention and the types of drug delivery devices 10 that are suitable for use in the present system. As described in more detail below, the syringes 10 can be supplied in a banded (bandolier) form or the syringes can be supplied as loose, non-banded syringes.

In the case of where the drug delivery devices 10 are syringes, the first station 120 is in the form of a syringe storage station that houses and stores a number of syringes 10. For example, up to 500 syringes or more can be disposed in the first station 120 for storage and later use. The first station 120 can be in the form of a bin or the like or any other type of structure that can hold a number of syringes 10. In one exemplary embodiment, the syringes 10 are provided as a bandolier structure that permits the syringes 10 to be fed into the other components of the system 100 using standard delivery techniques, such as a conveyor belt, etc. However, the present system can equally accommodate and process loose, non-bandoliered syringes.

The system 100 also includes a controllable transport mechanism or apparatus (device) 130 for the controlled movement of each syringe 10 from one location (station) to another location (station) and more specifically, the apparatus 130 can be in the form of a positional indexing apparatus that uses absolute encoder technology to track the position and location of specific points or areas/regions of the apparatus 130 or objects, such as syringes 10, associated therewith as they are moved by operation of the transport apparatus 130. In the case of processing syringes 10, the apparatus 130 is constructed to advance, with positional precision, the fed syringes 10 from and to various stations of the system 100.

Figure 6:
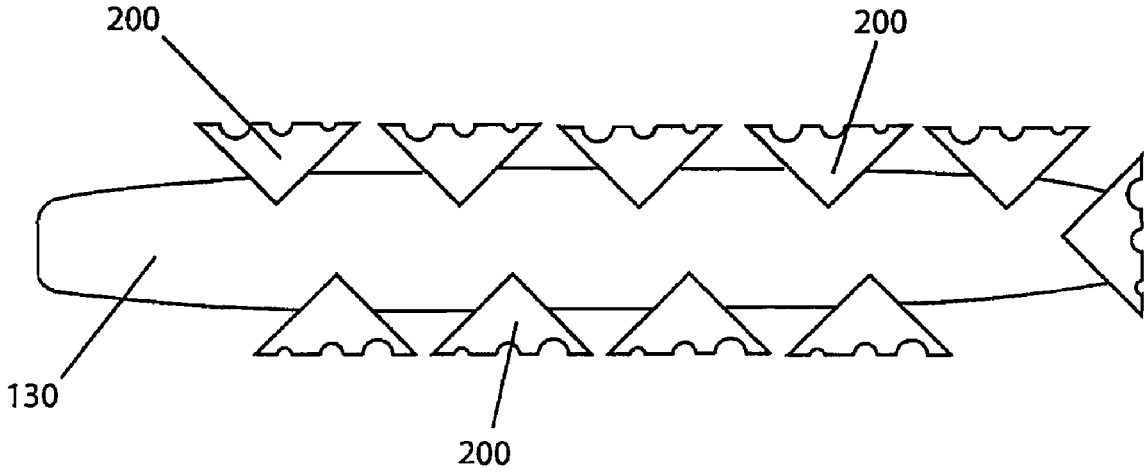
FIG. 6 is a top plan view of a linear indexing transport device for controllably moving the syringes from one location (station) to another location (station) and that includes one or more syringe blocks of FIG. 1.

The precise shape and size of the transport apparatus 130, as well as its processing capabilities, can vary depending upon the specific application and environment in which the apparatus 130 is used. For example, the transport apparatus 130 can be circular shaped (a rotary dial) as shown in FIG. 1 or it can be more of a linear type transport apparatus as shown in FIG. 6.

In the case of a circular shaped transport apparatus 130, a number of stations are arranged circumferentially around the transport apparatus 130 so that each syringe 10 is first loaded at the first station 120 and then rotated a predetermined distance to a next station, etc., as the medication preparation process advances. At each station, a different operation is performed with the end result being that a unit dose of medication is injected or otherwise delivered to the syringe 10 which is then ready to be administered.

One exemplary type of transport apparatus 130 is a multiple station cam-indexing circular dial that is adapted to perform material handling operations by using absolute encoder technology. The transport apparatus 130 is configured to have multiple stations positioned thereabout and includes individual retaining members for drug delivery devices or syringe blocks 200 as will be described below when the drug delivery devices are in the form of syringes, with the block 200 receiving and retaining the syringes 10. It will be appreciated that the drug delivery devices 10 are described herein as being syringes, this is merely one exemplary type of drug delivery device and other devices can equally be used. As described in greater detail below, each syringe can be held within one compartment or nest of the block 200 using any number of suitable techniques, including opposing spring-loaded fingers (FIGS. 11 and 12) that act to retain the syringe 10 in its respective block 200. The indexing/encoder aspects of the transport apparatus 130 permit the transport apparatus 130 to be advanced at specific intervals and in particular, permits each loaded syringe 10 to be delivered to a precise location, such as a next station, where it is further processed, etc.

At a second station 140, the syringes are loaded into one of the syringe blocks 200 of the transport apparatus 130. One syringe 10 is loaded into one compartment or nest of the syringe block 200 resulting in the syringe 10 being securely held in place. The system 100 preferably includes additional mechanisms for preparing the syringe 10 for use, such as removing a tip cap and extending a plunger of the syringe 10, at a third station 150. At this point, the syringe 10 is ready for use.

The system 100 also preferably includes one or more reading devices (not shown) that are capable of reading a label disposed on a sealed container containing the medication (e.g., a drug vial) or a label associated with the syringe 10 or some other object. The label is read using any number of suitable reader/scanner devices, such as a bar code reader, etc., so as to confirm that the proper medication has been selected from the storage unit of the station 110 and/or to confirm that the proper syringe 10 has been selected. Multiple readers can be employed in the system at various locations to confirm the accuracy of the entire process.

Figure 2:
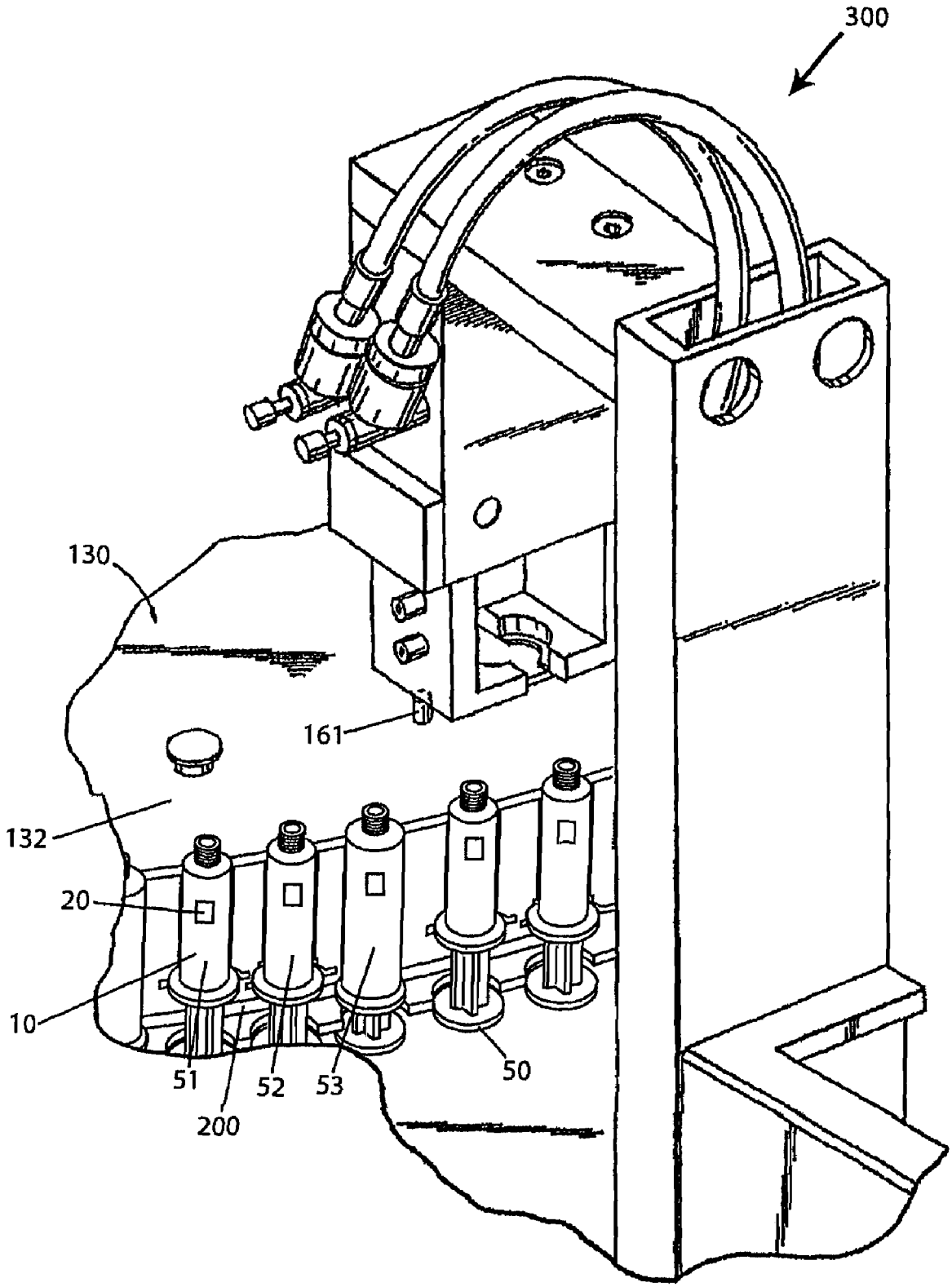
FIG. 2 is a local perspective view of an automated device for removing a safety cap from a syringe.

According to one aspect of the present invention illustrated in FIG. 2, the drug delivery device (syringe) 10 has a readable or readable/rewritable medium 20 that is associated therein and in particular is securely attached thereto. In one exemplary embodiment, the medium 20 is an integrated circuit, such as an RFID tag 20.

The RFID tag 20 includes a write/read memory for storing predetermined information and a built-in antenna for communicating with an RF reader/writer to permit information to be transferred to and stored in the memory of the RFID tag 20 and/or permits information stored in the memory of the RFID tag 20 to be read by the RF reader. More specifically, the RF reader can include an antenna for reading information stored in the RFID tag 20, e.g., by transmitting an RF interrogation signal to induce the RFID tag 20 to transmit its information to the RF reader which is detected by the antenna. The RFID tag 20 can be one of two different types in that the RFID tag 20 can be active (powered by an internal power source) or it can be passive (powdered by an RF signal transmitted from the RF reader).

The RFID tag 20 can be attached to the drug delivery device (syringe) 10 using any number of techniques as described below and is intended to store information related to the medical product contained with the drug delivery device 10 or can even contain information that relates to the drug delivery device 10 itself. For example, the information in the RFID tag 20 can include product information, such as a serial number and/or a National Drug Code (NDC) associated with the medical product, a product name, a manufacturer's name, a lot number and/or an expiration date.

It will also be appreciated that other types of custom information can be contained in the RFID tag 20 and more specifically, the RFID tag 20 can contain a product identifier uniquely associated with one or more entries in a database that can be accessed to obtain information related to the medical product. In addition, the information in the RFID tag 20 preferably includes dosage information that identifies the amount and/or concentration of the medical product, and/or a patient identifier that identifies a patient that is intended to receive this particular medical product. It will further be appreciated that the RFID tag 20 can contain other useful information in that it can contain administration requirements, instructions for use, and/or product warnings, such as possible allergic reactions or adverse interaction of the medical product with other medical products.

The information contained in the RFID tag 20 can also contain information that is related to the drug delivery device 10. For example, the manufacturer and identifying information, such as the size or capacity of the drug delivery device 10, can be contained in the RFID tag 20. In the case where the drug delivery device 10 is a syringe or IV bag, the identifying information can be in the form of a volume or capacity of the drug delivery device 10. For example, syringes come in different sizes, such as 10 ml, 50 ml, 100 ml, etc., and therefore, during an operation, such as transfer or filling of the drug delivery device 10 with the drug product, as described in detail below, it is desirable to confirm that the drug delivery device 10 is of the correct type before the medical product is delivered to the drug delivery device 10.

The information can be written into the RFID tag 20 at any number of different locations and times and by different persons. For example, some of the information may be written into the RFID tag 20 by the manufacturer of the medical product and/or by the manufacturer of the drug delivery device 10 as in the case where the type and/or size of the device 10 is written into the RFID tag 20.

The RFID tag 20 is preferably made thin and flexible to permit the RFID tag 20 to be attached to the drug delivery device 10 so that it does not interfere with using the drug delivery device 10. In other words, the RFID tag 20 can be formed so that it can be easily affixed around the barrel of a syringe 10.

Any number of different means can be used to attach or couple the RFID tag 20 to the drug delivery device 10. For example, the RFID tag 20 can contain an adhesive layer and a protective, release backing or cover over the adhesive layer such that when the user is ready to attach the RFID tag 20, the protective cover is removed, thereby exposing the adhesive layer and then the adhesive layer is brought into contact with the surface of the drug delivery device 10. It will also be appreciated that the RFID tag 20 can be removably attached using a hook and loop type fastener. In another embodiment, the RFID tag 20 is at least partially encapsulated or embedded within the drug delivery device 10. For example, the RFID tag 20 can be at least partially embedded within a wall of the drug delivery device 10 during the manufacture of the drug delivery device 10.

In one aspect, the RFID tag 20 is removably attached such that the tag 20 is not simply discarded with the drug delivery device 10 after use and this leads to cost savings. The releasable attachment of the RFID tag 20 can be accomplished in any number of different ways including the attachment techniques described above and the insertion of the RFID tag 20 in a sleeve or pocket or the like that is associated with the drug delivery device 10. In yet another aspect that is described below in detail, the detachable RFID tag 20 is removed from the drug delivery device 10, after the intended application is complete, and can be archived for later consultation. In other words, the RFID tag 20 can be placed in a log book and identified in the log book by some type of identifying information and if at a future date, there is a need to view the information contained in the RFID tag 20, the tag 20 is simply retrieved and its information is viewed.

It will also be appreciated that the process of affixing the RFID tag 20 to the drug delivery device 10 can be performed either manually or it can be performed as part of an automated system where a robotic device or the like can attach the RFID tag 20 to the drug delivery device 10. For example, the robotic device can include a reel of RFID tags 20 and adhesive tape with a backing, protective layer, with the device containing an automated means for removing the backing layer from the adhesive tape and then applying the RFID tag 20 to the drug delivery device 10, e.g., to the barrel of a syringe.

RFID tags 20 offer a number of advantages over conventional barcode tags. For example, the RFID tag 20 does not require a line of sight between itself and the RFID tag 20 to read the information in the RFID tag 20. In addition, the RF reader can read many RFID tags 20 at a time, while a barcode reader or scanner can only read one barcode tag at a time. Moreover, RFID tags 20 can be smaller, more accurate, more durable and are capable of storing more information than barcode tags. Another disadvantage related to the use of barcodes is that barcodes can only contain a limited amount of information as opposed to an RFID tag 20 that contain a vast amount of information.

In the case where the RFID tag 20 is a readable only tag, an RF reader is provided and in the more desirable application where the RFID tag 20 is a readable and rewritable medium, an RF reader/writer is provided. Further details about the RFID tag 20 are set forth below.

Once the system 100 confirms that the sealed container that has been selected contains the proper medication, the container is delivered to a fourth station 160 using an automated mechanism, such a robotic gripping device as will be described in greater detail. At the fourth station 160, the vial is prepared by removing the safety cap from the sealed container and then cleaning the exposed end of the vial. Preferably, the safety cap is removed and placed on a deck of the automated system 100 having a controlled environment. In this manner, the safety cap is removed just-in-time for use.

The system 100 also preferably includes a fifth station (fluid transfer station) 570 for injecting or delivering a diluent into the medication contained in the sealed container and then subsequently mixing the medication and the diluent to form the medication composition that is to be disposed into the prepared syringe. At this fluid transfer station, the prepared medication composition is withdrawn from the container (i.e., vial) and is then delivered into the syringe. For example, a cannula can be inserted into the sealed vial and the medication composition then aspirated into a cannula set. The cannula is then withdrawn from the vial and is then rotated relative to the rotary apparatus 130 so that it is in line with (above, below, etc.) the syringe. The unit dose of the medication composition is then delivered to the syringe, as well as additional diluent if necessary or desired. The tip cap is then placed back on the syringe at a sixth station 180. Alternatively, if the medication is already prepared (e.g., premixed) and/or does not require any dilution, then the fluid transfer station is configured to deliver a unit dose of medication to the interior of the syringe 10.

A seventh station 190 prints and station 195 applies a label to the syringe 10 and a device, such as a reader, can be used to verify that this label is placed in a correct location and the printing thereon is readable. Also, the reader can confirm that the label properly identifies the medication composition that is contained in the syringe. As discussed in more detail below, the reader can be of the type that reads the RFID tag 20.

The syringe 10 is then unloaded from the transport apparatus 130 at an unloading station 199 and delivered to a predetermined location, such as a new order bin, a conveyor, a sorting device, or a reject bin. The delivery of the syringe 10 can be accomplished using a standard conveyor or other type of apparatus. If the syringe is provided as a part of the previously-mentioned syringe bandolier, the bandolier is cut prior at a station 198 located prior to the unloading station 199.

An automated device, such as the device 300 shown in FIG. 2, removes a tip cap from a barrel tip, as part of the third station 150 (FIG. 1) of the automated medication preparation system 100, as the syringe 10 is prepared for receiving a prescribed dose of medication. The device 300 is a controllable device that is operatively connected to a control unit, such as a computer, which drives the device 300 to specific locations at selected times. The control unit can be a personal computer that runs one or more programs to ensure coordinated operation of all of the components of the system 100. The device 300 and other suitable devices described in greater detail in commonly assigned U.S. Pat. No. 7,017,622, which is hereby incorporated by reference in its entirety.

As previously mentioned, one exemplary transport device 130 is a multiple station cam-indexing circular dial that is adapted to perform material handling operations. The circular transport device 130 has an upper surface 132 and contains some type of means for retaining and securely holding the syringe 10 in a predetermined location and orientation relative to the device 130 as described in detail below with reference to FIGS. 8-12.

FIG. 2 shows the syringe block 200 as an integral part of the transport device and is of the type that can hold three different sized syringes (S1, S2, S3) by means of locating and retaining features that are described in more detail below. As the transport device 130 is moved, the syringes 10 are moved. A post 161 is provided for holding the tip cap associated with the syringe 10 after its removal to permit the syringe 10 to be filled with medication. One exemplary post 161 has a circular cross-section and is formed on the upper surface 132 of the transport device 130. Thus, the precise location of the post 161 can vary so long as the post 161 is located where the tip cap can sit without interfering with the operation of any of the automated devices and also the post 161 should not be unnecessarily too far away from the held syringe 10 since it is desired for the automated devices to travel a minimum distance during their operation to improve the overall efficiency of the system 100. The specific shape of the post 161 can likewise vary so long as the post 161 can hold the tip cap so that it remains on the post 161 during the rotation of the transport device 130 as the associated syringe 10 is advanced from one station to another station.

While in one exemplary embodiment, the syringes 10 are fed to the transport device 130 as part of a syringe bandolier (i.e., multiple syringes 10 disposed in series and interconnected by a web), it will be appreciated that the syringes 10 can be fed to the transport device 130 in any number of other ways. For example, the syringes 10 can be fed individually into the transport device 130 from a loose supply of syringes 10 and then held by spring actuated means, such as those shown in FIGS. 11-12, or by a vacuum means, etc.

The illustrated automated device 300 is a robotic device and preferably, the automated device 300 is a linear actuator with a gripper or some type of other device.

Figure 3:
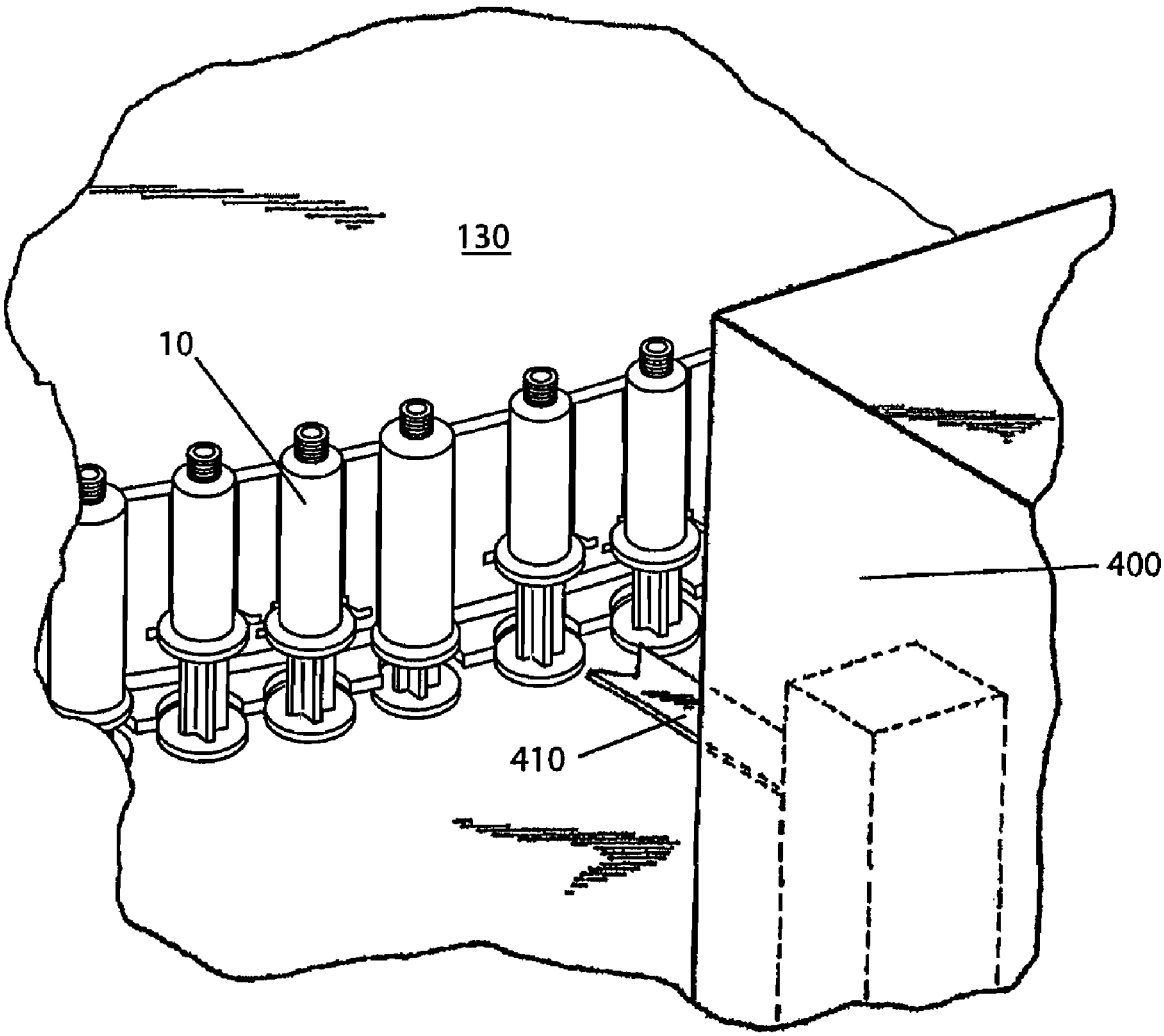
FIG. 3 is a local perspective view of a device for extending a plunger of a syringe a prescribed distance.

FIG. 3 illustrates an automated device 400 for extending the plunger 50 of the syringe 10 a predetermined distance so that the syringe 10 can receive a desired dose based upon the particular syringe 10 being used and the type of application (e.g., patient's needs) that the syringe 10 is to be used for. A suitable device 400 is described and illustrated in commonly assigned U.S. Pat. No. 6,877,530, which is hereby incorporated by reference in its entirety.

The device 400 is part of the overall programmable system and therefore, the distance that the gripper 410 corresponds to a prescribed movement of the plunger and a corresponding increase in the available volume of the interior of the barrel. For example, if the prescribed unit dose for a particular syringe 10 is 8 ml, then the controller instructs the device 400 to move the gripper a predetermined distance that corresponds with the plunger moving the necessary distance so that the volume of the barrel chamber is at least 8 ml. This permits the unit dose of 8 ml to be delivered into the barrel chamber.

In one example, after the syringe 10 has been prepared by removing the tip cap 40 and extending the plunger 50 a prescribed distance, the syringe 10 is then delivered to a fluid transfer station where a fluid transfer device 500 prepares and delivers the desired amount of medication.

Figure 4:
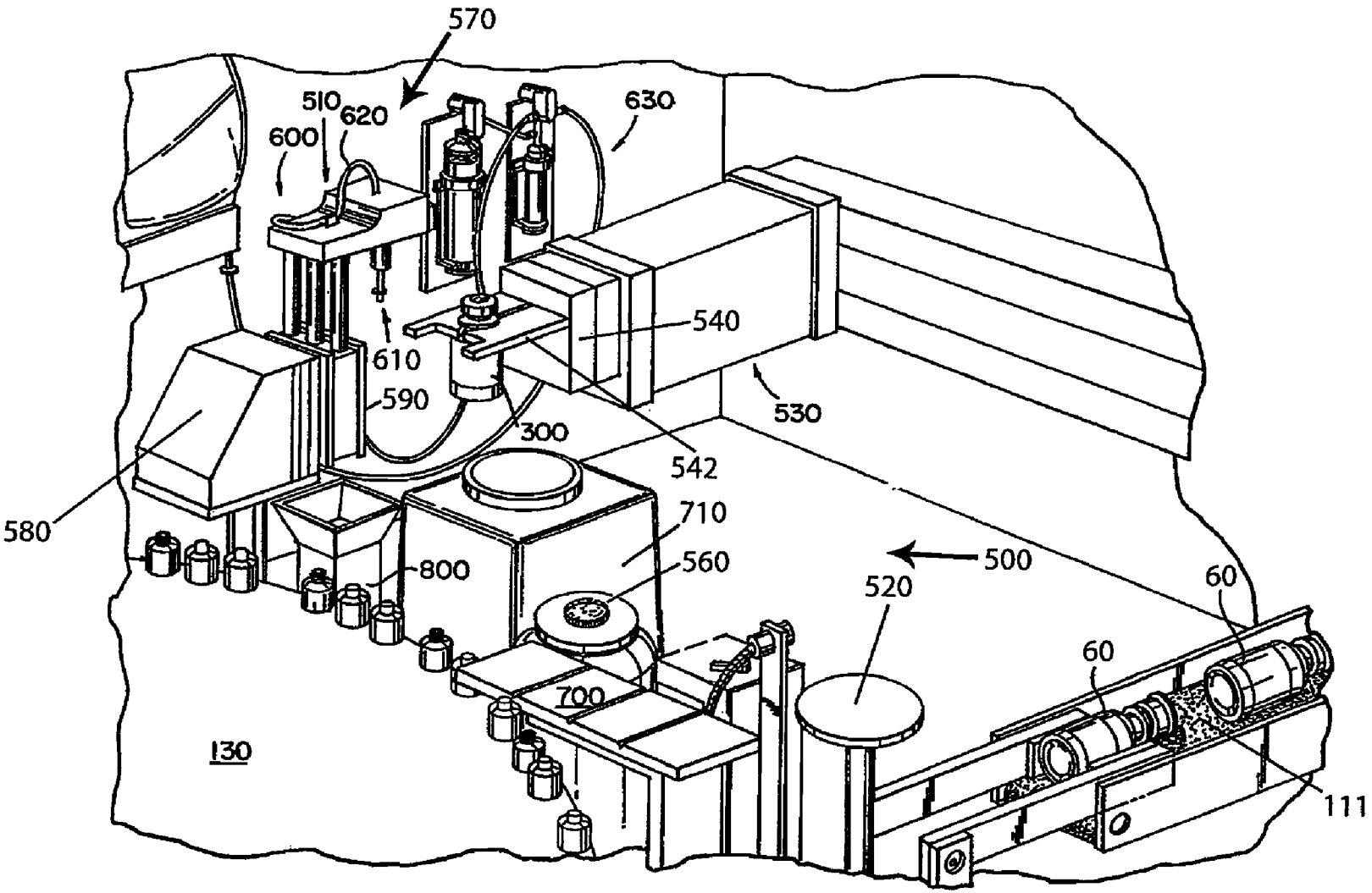
FIG. 4 is a local perspective view of a fluid transfer and vial preparation equipment in a fluid transfer area of the automated system.

Now turning to FIGS. 1 and 4 in which a drug preparation area is illustrated in greater detail to show the individual components thereof. More specifically, a drug transfer area is illustrated and is located proximate the transport device 130 so that after one drug vial 60 is prepared, the contents thereof can be easily delivered to syringes 10 that are securely held in nested fashion on the rotary dial 130. As previously mentioned, drug vials 60 are stored typically in the storage cabinet 110 and can be in either liquid form or solid form. A driven member, such as a conveyor belt 111 delivers the drug vial 60 from the cabinet 110 to a first mechanism 510 (e.g., pivotable vial gripper mechanism) that receives the vial 60 in a horizontal position and after gripping the vial with arms or the like, the mechanism 510 pivots upright so that the vial 60 is moved a vertical position relative to the ground and is held in an upright manner.

The mechanism 510 is designed to deliver the vial 60 to a rotatable pedestal 520 that receives the vial 60 once the grippers of the mechanism 510 are released. The vial 60 sits upright on the pedestal 520 near one edge thereof that faces the mechanism 510 and is then rotated so that the vial 60 is moved toward the other side of the pedestal 520. As the pedestal rotates, the vial 60 is scanned and a photoimage thereof is taken and the vial 60 is identified using the identification process and techniques set forth in commonly assigned U.S. Pat. No. 7,017,623, which is hereby expressly incorporated by reference in its entirety.

If the vial 60 is not the correct vial, then the vial 60 is not used and is discarded using a gripper device that can capture and remove the vial 60 from the pedestal before it is delivered to the next processing station. The central control has a database that stores all the identifying information for the vials 60 and therefore, when a dose is being prepared, the controller knows which vial (by its identifying information) is to be delivered from the cabinet 110 to the pedestal 520. If the scanning process and other safety features does not result in a clear positive identification of the vial as compared to the stored identifying information, then the vial is automatically discarded and the controller will instruct the system to start over and retrieve a new vial.

If the vial 60 is identified as being the correct vial, then a vial gripper device 530 moves over to the pedestal for retrieving the vial 60. The vial gripper device 530 is configured to securely grip and carry the vial in a nested manner to the next stations as the drug is prepared for use. Next the gripper unit 540 is moved upward and the device 530 is driven back to the opposite side so as to introduce the vial 60 to the next station. The vial 60 is also inverted by inversion of the gripper unit 540 so that the vial 60 is disposed upside down.

The inverted vial 60 is then delivered to a station 550 where the vial 60 is prepared by removing the safety cap from vial 60. This station 550 can therefore be called a vial decapper station. Any number of devices can be used at station 550 to remove the safety cap from the vial. For example, several exemplary decapper devices are disclosed in commonly-assigned U.S. Pat. No. 6,604,903 which is hereby incorporated by reference in its entirety. After the vial 60 is decapped, the vial is then delivered, still in the inverted position, to a cleaning station 560 where the exposed end of the vial is cleaned. For example, underneath the removed vial safety cap, there is a septum that can be pierced to gain access to the contents of the vial. The cleaning station 560 can be in the form of a swab station that has a wick saturated with a cleaning solution, such as an alcohol. The exposed area of the vial 60 is cleaned by making several passes over the saturated wick which contacts and baths the exposed area with cleaning solution. After the vial 60 is cleaned at the station 560, the gripper unit 540 rotates so that the vial 60 is returned to its upright position and remains held between the gripper arms 542.

The device 530 then advances forward to a fluid transfer station 570. The fluid transfer station 570 is an automated station where the medication (drug) can be processed so that it is in a proper form for injection into one of the syringes 10 that is coupled to the rotary dial 130. When the vial 60 contains only a solid medication and it is necessary for a diluent (e.g., water or other fluid) to be added to liquify the solid, this process is called a reconstitution process. Alternatively and as will be described in detail below, the medication can already be prepared and therefore, in this embodiment, the fluid transfer station is a station where a precise amount of medication is simply aspirated or withdrawn from the vial 60 and delivered to the syringe 10.

For purpose of illustration, the reconstitution process is described below. After having been cleaned, the vial 60 containing a prescribed amount of solid medication is delivered in the upright position to the fluid transfer station 570 by the device 530 as shown in FIG. 4. As will be appreciated, the device 530 has a wide range of movements in the x, y and z directions and therefore, the vial 60 can easily be moved to a set fluid transfer position. At this position, the vial 60 remains upright and a fluid transfer device 580 is brought into position relative to the vial 60 so that a fluid transfer can result therebetween. More specifically, the fluid transfer device 580 is the main means for both discharging a precise amount of diluent into the vial 60 to reconstitute the medication and also for aspirating or withdrawing the reconstituted medication from the vial 60 in a precise, prescribed amount. The device 580 is a controllable device that is operatively connected to a control unit, such as a computer, which drives the device 580 to specific locations at selected times. The control unit can be a personal computer that runs one or more programs to ensure the coordinated operation of all of the components of the system 100.

It will be appreciated that in some applications, the medication does not have to be reconstituted as in the case of previously reconstituted or premixed medications and therefore, the prescribed unit dose of medication is merely delivered from the medication container to the syringe 10. Also, the fluid transfer station can be configured so that a dilution process is performed to dilute existing medication to a prescribed, desired concentration and then deliver a prescribed unit dose of medication to the syringe 10.

The details of one exemplary fluid transfer device 580 are set forth in commonly assigned U.S. Pat. No. 6,915,823, which is hereby expressly incorporated by reference in its entirety. The device 580 can include a rotatable cannula unit 590 that has a degree of rotation relative to its base. At one end of a cannula housing 600 a cannula 610 is provided and includes a distal end that serves to pierce the septum of the vial 60 and an opposite end that is connected to a main conduit 620 that serves to both deliver diluent to the cannula 610 and ultimately to the vial 60 and receive aspirated medication from the vial 60. Preferably, the cannula 610 is of the type that is known as a vented cannula which is vented to atmosphere as a means for eliminating any dripping or spattering of the medication during an aspiration process. More specifically, the use of a vented needle to add (and withdraw) the fluid to the vial overcomes a number of shortcoming associated with cannula fluid transfer and in particular, the use of this type of needle prevents backpressure in the vial (which can result in blow out or spitting or spraying of the fluid through the piercing hole of the cannula). The venting takes place via an atmospheric vent that is located in a clean air space and is formed in a specially designed hub that is disposed over the needle. By varying the depth that the needle penetrates the vial, the user can control whether the vent is activated or not. It will be appreciated that the venting action is a form of drip control (spitting) that may otherwise take place.

Moreover, the cannula 610 is also preferably of the type that is motorized so that the tip of the cannula 610 can move around within the vial 60 so that cannula 610 can locate and aspirate every last drop of the medication. In other words, the cannula 610 itself is mounted within the cannula unit 590 so that it can move slightly therein such that the tip moves within the vial and can be brought into contact with the medication wherever the medication may lie within the vial 60. Thus, the cannula 610 is driven so that it can be moved at least laterally within the vial 60.

Any number of pump means or delivery means can be used as part of the fluid transfer device 580 to cause controlled discharge and/or aspiration of medication. For example, previously mentioned U.S. Pat. No. 6,915,823 sets forth a suitable pump means in the form of a pair of controllable syringes.

It will also be appreciated that the fluid transfer station 570 can be of the type where the drug is not reconstituted but instead, the medication is directly dispensed to the syringe by inserting the syringe tip into a filled drug vial and then withdrawing the plunger of the syringe the proper distance so as to cause the proper and desired amount of medication to be aspirated into the syringe. For example, a syringe plunger withdrawal device is disclosed in commonly assigned U.S. Pat. No. 6,877,530, which is hereby incorporated by reference in its entirety. However, it will be understood that other mechanisms or means can be used for withdrawing the plunger a predetermined distance resulting in an accurate volume of medication being drawn into the syringe.

Once the syringe 10 receives the complete prescribed medication dose, the vial 60 that is positioned at the fluid transfer position can either be (1) discarded or (2) it can be delivered to a holding station 700 where it is cataloged and held for additional future use. More specifically, the holding station 700 serves as a parking location where a vial that is not completely used can be used later in the preparation of a downstream syringe 10. In other words, the vials 60 that are stored at the holding station 700 are labeled as multi-use medications that can be reused. These multi-use vials 60 are fully reconstituted so that at the time of the next use, the medication is only aspirated from the vials 60 as opposed to having to first inject diluent to reconstitute the medication. The user can easily input into the database of the master controller which medications are multi-use medications and thus when the vial 60 is scanned and identified prior to being delivered to the fluid transfer position, the vial 60 is identified and marked as a multi-use medication and thus, once the entire medication dose transfer has been performed, the vial gripper device 530 is instructed to deliver the vial 60 to the holding station 700. Typically, multi-use medications are those medications that are more expensive than other medications and also are those medications that are used in larger volumes (quantities) or are stored in larger containers and therefore come in large volumes.

The holding station 700 is simply a location where the multi-use vials can be easily stored. For example, the holding station 700 is preferably a shelf or even a cabinet that contains a flat surface for placing the vials 60. Preferably, there is a means for categorizing and inventorying the vials 60 that are placed at the holding station 700. For example, a grid with distinct coordinates can be created to make it easy to determine where each vial 60 is stored within the holding station 700.

Once the device 530 has positioned the gripper unit 540 at the proper location of the holding station 700, the gripper unit 540 is operated so that the arms thereof release the vial 60 at the proper location. The device 530 then returns back to its default position where it can then next be instructed to retrieve a new vial 60 from the pedestal 520.

If the vial 60 is not a multi-use medication, then the vial 60 at the fluid transfer position is discarded. When this occurs, the device 530 moves such that the vial 60 is positioned over a waste chute or receptacle and then the gripper unit 540 is actuated to cause the vial 60 to drop therefrom into the waste chute or receptacle. The device 530 is then ready to go and retrieve a new vial 60 that is positioned at the pedestal 520 for purposes of either reconstituting the medication or simply aspirating an amount of medication therefrom or a vial from the holding station 700 can be retrieved.

As previously mentioned, during the reconstitution process, it is often necessary or preferable to mix the medication beyond the mere inversion of the vial and therefore, the vial 60 can be further agitated using a mixing device or the like 710. In one embodiment, the mixing device 710 is a vortex type mixer that has a top surface on which the vial 60 is placed and then upon actuation of the mixer, the vial 60 is vibrated or otherwise shaken to cause all of the solid medication to go into solution or cause the medication to be otherwise mixed. In yet another embodiment, the mixing device is a mechanical shaker device, such as those that are used to hold and shake paint cans. For example, the vial 60 can be placed on a support surface of the shaker and then an adjustable hold down bar is manipulated so that it travels towards the vial and engages the vial at an end opposite the support surface. Once the vial 60 is securely captured between these two members, the shaker device is actuated resulting in the vial 60 being shaken to agitate the medication and ensure that all of the medication properly goes into solution. This type of mixing device can also be configured so that it is in the form of a robotic arm that holds the vial by means of gripper members (fingers) and is operatively connected to a motor or the like which serves to rapidly move the arm in a back and forth manner to cause mixing of the medication.

As briefly mentioned before, the entire system 100 is integrated and automated and also utilizes a database for storing identifying data, mixing instructions, and other information to assist in the preparation of the medication. There are also a number of safety features and check locations to make sure that the medication preparation is proceeding as it should.

For example, the database includes identifying information so that each vial 60 and syringe 10 can be carefully kept track of during each step of the process. For example, a scanner 720 and the photoimaging equipment serve to positively identify the vial 60 that is delivered from the drug storage 110. Typically, the user will enter one or more medication preparation orders where the system 100 is instructed to prepare one or more syringes that contain specific medication. Based on this entered information or on a stored medication preparation order that is retrieved from a database, the vial master controller determines at which location in the cabinet the correct vial 60 is located. That vial 60 is then removed using a robotic gripper device (not shown) or other device and is then placed on the conveyor belt 111 and delivered to the mechanism 510 which pivots upright so that the vial 60 is moved a vertical position relative to the ground and is held in an upright manner and is then delivered to the rotatable pedestal 520. At the pedestal 520, the vial 60 is scanned to attempt to positively identify the vial 60 and if the scanned identifying information matches the stored information, the vial 60 is permitted to proceed to the next station. Otherwise, the vial 60 is discarded or some other type of action is taken.

Once the vial 60 is confirmed to be the right vial it proceeds to the fluid transfer position. The master controller serves to precisely calculate how the fluid transfer operation is to be performed and then monitors the fluid transfer operations as it is occurring. More specifically, the master controller first determines the steps necessary to undertake in order to perform the reconstitution operation. Most often during a reconstitution operation, the vial 60 that is retrieved from the drug storage 110 contains a certain amount of medication in the solid form. In order to properly reconstitute the medication, it is necessary to know what the desired concentration of the resulting medication is to be since this determines how much diluent is to be added to the vial 60. Thus, one piece of information that the user is initially asked to enter is the concentration of the medication that is to be delivered to the patient as well as the amount that is to be delivered. Based on the desired concentration of the medication, the master controller is able to calculate how much diluent is to be added to the solid medication in the vial 60 to fully reconstitute the medication. Moreover, the database also preferably includes instructions as to the mixing process in that the mixing device is linked to and is in communication with the master controller so that the time that the mixing device is operated is stored in the database such that once the user inputs the medication that is to be prepared and once the vial 60 is scanned and identified, the system (master controller or CPU thereof) determines the correct amount of time that the vial 60 is to be shaken to ensure that all of the medication goes into solution.

Once the master controller determines and instructs the working components on how the reconstitution operation should proceed, the master controller also calculates and prepares instructions on how many distinct fluid transfers are necessary to deliver the prescribed amount of medication from the vial 60 to the syringe 10. In other words, the cannula unit 590 may not be able to fully aspirate the total amount of medication from the vial 60 in one operation and therefore, the master controller determines how many transfer are needed and also the appropriate volume of each aspiration so that the sum of the aspiration amounts is equal to the amount of medication that is to be delivered to the syringe 10. Thus, when multiple aspiration/discharge steps are required, the master controller instructs and controls the operation of the drivers so that the precise amounts of medication are aspirated and then discharged into the syringe 10. As previously described, the pump means (syringe drivers) retract and advance at the right levels to cause the proper dose amount of the medication to be first aspirated from the vial and then discharged into the syringe. This process is repeated as necessary until the correct dose amount is present in the syringe 10 in accordance with the initial inputted instructions of the user.

After transferring the proper precise amount of medication to one syringe 10, the master controller instructs the transport device 130 to move forward in an indexed manner so that the next empty syringe 10 is brought into the fluid transfer position. The cannula 610 is also preferably cleaned after each medication dose transfer is completed so as to permit the cannula 610 to be reused. There are a number of different techniques that can be used to clean the cannula 610 between each medication transfer operation. For example, the cleaning equipment and techniques described in commonly assigned U.S. Pat. No. 6,616,771 and U.S. patent application Ser. No. 10/457,898 (both of which are hereby incorporated by reference in their entireties) are both suitable for use in the cleaning of the cannula 610.

In one embodiment, the cannula 610 is rotated and positioned so that the needle of the cannula 610 is lowered into a bath so that fluid is expelled between the inside hubs of the syringe 10 for cleaning of the interior components of the cannula 610. The cannula 610 is then preferably dipped into a bath or reservoir to clean the outside of the cannula 610. In this manner, the cannula 610 can be fully cleaned and ready for a next use without the need for replacement of the cannula 610, which can be quite a costly endeavor.

In commonly assigned U.S. patent application Ser. No. 10/457,066 (which is hereby incorporated by reference in its entirety), it is described how the plunger 50 of the syringe 10 can be extended with precision to a prescribed distance. In that application, the plunger 50 is extended to create a precise volume in the barrel that is to receive the medication that is injected therein at a downstream location. However, it will be appreciated that the action of extending the plunger 50 can serve more than this purpose since the extension of the plunger 50 creates negative pressure within the syringe barrel and thus can serve to draw a fluid therein. For example, once a connector (luer fitting) is sealingly mated with the open syringe tip end, the medication source is fluidly connected to the syringe 10 and thus can be drawn into the syringe barrel by means of the extension of the plunger 50. In other words, the plunger 50 is pulled a precise distance that results in the correct size cavity being opened up in the barrel for receiving the fluid but also the extension of the plunger creates enough negative pressure to cause the medication to be drawn into the syringe barrel. This is thus an alternative means for withdrawing the proper amount of medication from a member (in this case the medication source) and transferring the desired, precise amount of medication to the syringe 10. The operation of this alternative embodiment can be referred to as operating the system in reservoir mode. One advantage of this embodiment is that multiple syringe drivers are not needed to pump the medication into the syringe 10 but rather the drawing action is created right at the transport device 130. This design is thus fairly simple; however, it is not suitable for instances where drug reconstitution is necessary.

Prior to its using another drug, the cannula 610 is cleaned using conventional techniques, such as those described in the previously incorporated patents and patent applications.

After the medication is aspirated into the barrel, the transport device 130 is advanced so that the filled syringe 10 is delivered to the sixth station 180 (FIG. 1). For example, the transport device 130 is preferably advanced so that the filled syringe 10 is delivered to a station where the removed tip cap 40 is replaced back onto the barrel tip by a device, such as device 300 of FIG. 2.

According to one aspect of the present invention and when an RFID tag 20 is used in combination with the syringe 10, an RF reader or RF reader/writer 800 ("RF device") can be provided at any number of different locations of the automated system 100 where it is desired to have communication between the syringe 10 (RFID 20 thereof) and the RF reader/writer 800. In particular, the RF device 800 can be disposed between any two stations that form a part of the system 100. For example, there can be an RF reader 800 immediately downstream of the first station 110 that is used to confirm that the type of syringe is proper. As described in more detail below, the positional indexer 130 and the master controller are configured so that any one specific syringe 10 can be tracked at any time during its advancement from one location to another location, including when the syringe is docked at a particular station. Thus, the master controller assigns a specific coordinate identifier to each pocket of the syringe block 200 where one syringe 10 is stored and thus, when the reader 800 reads the RFID tag 20 and communicates the information to the master controller, the master controller can determine whether the proper syringe 10 is in the correct pocket by reading the identifier information contained on the RFID tag 20 and then comparing this information to the information stored in memory of the master controller.

For example, if a syringe block 200 identified as block [001] is supposed to contain one 25 ml syringe in one pocket, the reader 800 will be signaled by the RFID tag 20 as to the presence of the syringe in the block [001] and then the identification information that is read by the reader 800 is evaluated and compared with stored information to determine if the syringe is of the proper size, etc. In other words, the RFID tag 20 contains data that indicates that the size of the syringe to which the tag 20 is attached or associated with and therefore, the inputted size of the syringe that is stored in the master controller can easily be compared with the read size of the syringe. If there is a discrepancy, the mater controller alerts the user.

The RF device 800 is part of the overall system 100 such that it is in communication (e.g., wired or wireless) with other components of the system 100 and in particular, with one or more processors or controllers thereof, such as a master controller that can be in the form of a computer). This permits the information that is read by the RF device 800 to be compared with stored information to check the integrity of a process or application, such as the syringe filling step. In other words, the RF device 800 can be provided at a plurality of the stations of the system 100 for the purpose of writing information in the RFID tag 20 that relates to an operation that just took place at the particular station where the RF writer 800 is located. For example, at the station where the plunger of the syringe 10 is extended, the RF writer 800 can write the distance that the plunger was extended in the RFID tag 20. In addition, at the fluid transfer station 570, the RF writer 800 can write in the RFID tag 20 specific information that relates to the completed fluid transfer. For example, the amount and/or type of diluent that was added to the dry powder medication can be saved in the RFID tag 20 and time identifying information can be saved, such as a time when the diluent was added. Any other type of information can be written on the tag 20, such as information that identifies the details concerning the particular product and/or information relating to the patient or the delivery location for the product.

In yet another embodiment, the RF device 800 is located just prior to (upstream) the station 195 where a label or the like is printed for placement on the syringe. At this location, the RF device 800 can provide an integrity check prior to the label being printed and permanently placed on the syringe so as to ensure that the contents of the syringe are proper and/or other information is accurate, such as a patient identifier or location to which the syringe is to be delivered. For example, it is desirable prior to medication identifying information, such as the drug contents, dose, usage schedule/instructions, strength, warnings, etc., being printed on the label that the veracity of the drug contents is confirmed. In other words, the RFID tag 20 has medication identifying information written therein and the RF device 800 reads the information stored in the tag 20 and then compares it to information that is stored in memory (e.g., database) to check whether certain parameters are within appropriate limits or ranges or that the information written in the tag 20 matches the stored information. For example, the type of medication, the dosage amount, etc. must match between what is recorded on the RFID tag 20 and that which is stored in memory (e.g., database) and identified as corresponding to this particular syringe.

If a match does not exist or if the information is outside of a particular limit or range, then the system 100 is preferably configured so as to take affirmative action to be this particular syringe from being advanced to the next station and preferably, some type of warning (audible and/or visual) is provided to alert the operator as to the discrepancy between the information written in the tag 20 and that which was previously entered and stored in the system's memory. For example, if the RFID tag 20 indicates that the medication within the associated syringe is penicillin, due to this information being written in the tag 20 at the previous fluid transfer station; however, the information stored in the computer indicates that this particular syringe that is identified by a number of different means, including its location on the transport device 130, indicates that the syringe contains amoxicillin, then the system recognizes this discrepancy and appropriate remedial action is taken, which likely includes preventing the syringe 10 from being advanced to a next station alerting the operator. The records can be checked by the operator in an attempt to resolve the discrepancy and the operator may likewise wish to check syringes downstream in order to see if there are any differences between the information contained in the RFID tags 20 and the information stored in the computer's memory. Once the discrepancy is resolved, the operator can then restart the system and the transport device 130 to continue the operations that are performed at the respective stations. While the above example is discussed in terms of a discrepancy between the type of medication contained within the syringe, it will be appreciated that the discrepancy can be between any number of other pieces of identifying information, such as the dosage amount, the strength of the medication, patient identifying information, the location to which the medication is to be routed, etc.

In yet another aspect, the loading station 120 for the syringes can consist of a number of separate feed lines or hoppers when multiple sized syringes are used and when the syringes 10 are initially provided in a loose, non-banded form. For example, when there are three different sized syringes, there can be three separate hoppers or feed lines that each contains one size of syringe. Each syringe includes an RFID tag 20 and therefore, as the individual syringes 10 are delivered to a loading location where the individual syringes 10 are prepared, e.g., aligned and orientated, for placement in the individual pockets that complement the particular size of the syringe 10, the reader 800 can read the syringe identifying information contained on the RFID tag 20. More specifically, by reading the information contained on the RFID tag 20, the master controller can determine if the next syringe that is being loaded into the syringe block 200 is of the correct size since the controller tracks the precise position of the block 200 at the load station and it is known which pocket of the syringe block 200 is in the load position. Thus and for example, if the second pocket 220 that is intended to receive an S2 type syringe is in the load position, and the reader 800 and master controller detect by means of the RFID tag 20 that the syringe in the load position is an S3 type syringe, this discrepancy is noted and the system prevents the positioning of the S3 syringe in the S2 type pocket. The operator is notified and remedial action can be taken. Conversely, when the master controller through the reader 800 detects that an S2 syringe is in the load position, the master controller instructed the loading mechanism to continue with the loading of the syringe into the S2 type pocket.

It will be appreciated that this is merely one exemplary use of the RFID tag 20 and that any number of other uses can be envisioned for the RFID tag 20 since the free communication between the RFID tag 20 and the reader 800 and the master controller permits information to be received from the RFID tag 20 so as to influence or instruct how an operation is performed at one more stations and in addition, information can be written to the RFID tag 20 as a safety check and a means for later verifying certain events. Moreover, information that is written to the RFID tag 20 can later be read by a downstream reader 800 which then performs a certain operation based on the information that was written on the RFID tag 20.

It will be appreciated that the syringe identification information that is contained in the RFID tag 20 can be used in the bandoliering process when a number of loose syringes are banded together by the web to form a bandolier structure. Exemplary systems for bandoliering syringes are set forth in commonly assigned U.S. Pat. Nos. 6,986,234 and 7,007,443, both of which are hereby expressly incorporated by reference in their entireties. In other words, a reader 800 associated with the bandolier system can read the syringe identification information and determine whether the ordering of the syringes is proper since in accordance with the present invention, the bandolier structure does not simply contain syringes of the same size but instead contains different sized syringes that are arranged according to a predetermined order. Thus, if the improper sized syringe is located in the load position, the bandolier system can detect this and reject the syringe and instruct that the proper sized syringe be delivered to the load location before the interconnecting web is applied to the ordered syringes.

In addition, the syringe can contain the control feature that is described in commonly assigned U.S. Pat. Nos. 6,722,404 and 7,025,098, both of which are hereby expressly incorporated by reference in their entireties.

In yet another embodiment, the RFID tag 20 is removably coupled to the syringe 10 to permit reuse of the RFID tag 20 and/or to permit the tag 20 to be archived. For example, the detachable RFID tag 20 can be removed from the drug delivery device 10, after the intended application is complete, and can be archived for later consultation. In other words, the RFID tag 20 can be placed in a log book and identified in the log book by some type of identifying information and if at a future date, there is a need to view the information contained in the RFID tag 20, the tag 20 is simply retrieved and its information is viewed. Alternatively, the RFID tag 20 can be simply removed from the syringe and the information contained therein is cleared, thereby permitting the tag 20 to be reused on another syringe as by simply affixing the tag 20 to the other syringe.

Any number of different means or techniques can be used for associating one tag 20 to one syringe 10. For example, the syringe 10 can include a pocket or the like that is formed as part of or is attached to the outer surface of the syringe and is configured to receive and hold one tag 20. Alternatively, the RFID tag 20 can include some type of fastening means that mates with a feature formed as part of the syringe to permit the tag 20 and syringe 10 to be releasably locked with one another, e.g., a snap fit connection can be formed between the tag 20 and the syringe 10 or even a hook and loop type fastening can be formed between the two parts. The connection of the tag 20 to the syringe 10 should be strong and robust enough that the tag 20 is maintained on the syringe during the entire process and as it is advanced from station to station.

This arrangement permits the RFID tag 20 to be consistently reused instead of being discarded along with the used syringe after the medication contained therein has been discharged. This reduces the overall costs of the system since the tags 20 are not merely discarded but are used again.

In yet another embodiment, the RFID tag 20 is associated with the transport device 130 in that the tag 20 is affixed to a particular pocket or nest of the transport device 130 that receives and holds one syringe. In other words, each nest of the transport device 130 has an RFID tag 20 affixed thereto and associated therewith so that information is written in the RDIF tag 20 that relates to the specific syringe that is in the nest as it is advanced from one station to the next station. At specific target locations, the operator can have information written to the tag 20 that relates to the syringe that is within the associated pocket. For example, an initial reader/writer can be used to initial write to the syringe information, including instructions, that relate to the processing of this particular syringe. For example, the RFID tag 20 can have instructions written in it that are used to later control or somehow influence an operation that is performed at a later station. For example, the reader/writer can write instructions in the RFID tag 20 that relate to the distance that the plunger of the syringe is pulled as when the system includes a station or step where the plunger is automatically pulled by a controllable, mechanical device in preparation for the delivering of the medication or during the delivery of the medication to the syringe.

In addition, the RFID tag 20 can include information that relates to the operations that are performed at the fluid transfer station 570. For example, the tag 20 can include instructions that relate to how much diluent is added to the solid medication that is within the vial, how long the mixture of diluent and solid medication is to be mixed, etc. As a result and as shown in FIG. 1, a reader 800 can be disposed between the station 160 and the fluid transfer device 570 and is in communication with the master controller and thus, the fluid transfer device so that the RFID tag 20 instructs the fluid transfer device how to formulate and make the desired unit dose of medication.

In yet another aspect, the RFID tag 20 can have processing or routing information written therein in that the tag 20 includes instructions relating to how the syringe is to be processed after it has been filled. For example, the RFID tag 20 can include instructions or an identifier that identifies, at least in part, an end location or the like where the syringe is to be routed. For example, the tag 20 can include a code that represents a final destination, such as a hospital or a medical facility, clinic, etc. In other words, the routing of the syringes can be facilitated by introducing a code (number, letter, or a combination thereof) that identifies a specific location where the syringe should be delivered such that when the reader reads the code stored in the tag 20, the system takes the necessary steps to ensure that the syringe is delivered to the correct location. For example, a mechanical device, such as a sweeper or the like, that is part of the automated system and in communication with the control system can be operated to direct a first group of syringes along one route that ensures that all of the syringes of the first group are delivered or are packaged for delivery to a first location, while a second group of syringes is directed along a different route that ensures that all of the syringes of the second group are delivered or are packaged for delivery to a second location. In this manner, the RFID tag 20 provides instructions to the automated system for performing one or more operations therewith.

An end use location, such as a pharmacy or healthcare facility, typically includes a healthcare database that can include a patient file uniquely associated with each individual patient admitted in the healthcare facility. Each of the patient files can include the patient's name, address, social security number, and/or patient ID, which can be assigned to the patient upon admission to the healthcare facility. Each of the patient files may also include the medical products prescribed to the respective patient and/or a record of the medical products administered to the respective patient, including dates and time of administration, the healthcare worker who administered the medical products, and the like. Each of the patient files may also include the current location of the respective patient within the healthcare facility, e.g., the floor and/or room number of the patient in the healthcare facility. The information in the database can further include insurance billing information for each individual patient, including the name, telephone number, billing address, and/or group ID of the patient's insurer. In addition, the information in the database can include a healthcare worker file associated with each individual healthcare worker working at the healthcare facility.

In a first step, the facility, such as a pharmacy, receives a shipment of medical products, such as filled syringes. Preferably, each of the medical products can be identified by one RFID tag 20 which is preferably attached to the syringe itself or could be attached to a package or container that contains the medical product. Each of the tags 20 preferably includes product information for the associated medical product, including a serial number and/or a NDC, the product name, the manufacturer's name, a lot number, and/or an expiration date. Alternatively, or in addition, each of the tags 20 can include a product identifier uniquely associated with one or more entries in a database that may be accessed to obtain information related to the associated medical product.

In a second step, the product information in the RFID tags 20 of the received medical products is read into a terminal (e.g., a PC) at the facility using the RF reader. In another step, the terminal transmits the product information read from the tags 20 of the received medical products to a main computer via a conventional communication link (wired or wireless). The computer can use this received information to update the inventory in the database accordingly. In an optional step, the main computer at the end facility and the database thereof receives information of the medical products shipped to the healthcare facility from the manufacturer (i.e., where the syringes are filled). This information can be downloaded into the database from a remote manufacturer database (not shown) via, e.g., an Internet link. From a CD-ROM disc included with the medical product shipment, or the like. The information of the medical products shipped to the healthcare facility can include the serial number, NDC, and product name of each of the medical products shipped to the healthcare facility.

In a next step, the main computer compares the information of the medical products shipped to the healthcare facility with the information received from the terminal at the facility to verify that all of the medical products shipped to the healthcare facility were received by the pharmacy. The comparison can be done between serial numbers of the medical products or some other identifying information of the medical products.

After the medical product is prepared for the patient, the medical product can be grouped with other prepared medical products for transport to a medication-dispensing unit. As the medical products are withdrawn from a facility, such as the pharmacy, for transportation to the medical-dispensing unit, the information in the tags 20 of the medical products can be read into a terminal using the RF reader. For example, all of the medical products can be identified by passing a cart or other device carrying the medical products into close proximity with the RF reader, thereby simultaneously reading all of the tags 20 identifying the medical products.

For example, the RF reader can be mounted to a doorway of the facility (pharmacy) for automatically reading the RFID tags 20 of the medical products as they are withdrawn from the facility. The terminal at the facility (pharmacy) can also identify the medication-dispensing unit intended to receive the medical products. This can be done by having a healthcare worker manually entering the identity of the of the dispensing unit into the pharmacy terminal and/or reading an RFID tag 20 identifying the dispensing unit using the RF reader. This can also be done by reading a patient identifier and/or location from the RF tags 20 of the medical products into the pharmacy terminal and having the pharmacy terminal access a database matching the patient identifier and/or location with an assigned dispensing unit.

The pharmacy terminal can then transmit the information read from the RFID tags 20 of the medical products to the main computer and can likewise transmit the identity of the dispensing unit to receive the medical products and/or the identity of the healthcare worker transporting the medical products to the dispensing unit. Medication dispensing units can be placed throughout the medical facility for temporarily storing medical products and for dispensing the medical products to the healthcare workers, e.g., nurses, assigned to administer the medical products to the patients. Each of the medication dispensing units, e.g., stationary medication stations and/or movable medication carts, can be located on the same floor, wing, and the like of the healthcare facility as the patients intended to receive the medical products stored therein.

It will be appreciated that after the desired safety checks and the veracity of the information contained in the tag 20 and in the computer system is confirmed and after the syringe is removed from the syringe block 200, the information in the RFID tag 20 can be cleared to permit so as to permit new information to be written in the tag 20 when it advances to the station where a new syringe is introduced and held within the pocket with which the tag 20 is associated. This ensures that the filled syringe 10 contains the correct medication and that the information that is to be printed on the label and then applied to the syringe is correct.

In yet another aspect the tags 20 can be integrally attached to the drug delivery device 10 (e.g., syringe) at the time of forming the drug delivery device. In the case when the drug delivery device is a syringe, the tag 20 once again is embedded within the wall (e.g., a barrel wall) of the syringe 10 during the manufacture process of the syringe 10. This results in an integral, permanent attachment of the tag 20 to the drug delivery device 10, e.g., the syringe.

Figure 5:
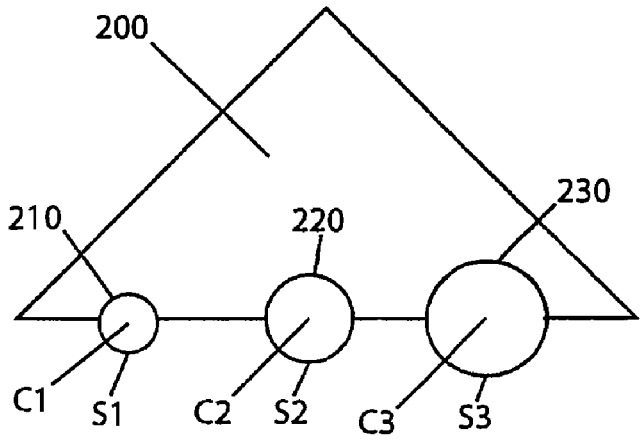
FIG. 5 is a top plan view of one syringe block of FIG. 1.

Referring now to FIGS. 5-6, one exemplary block 200 according to the present invention is illustrated and is associated with the transport device 130, which is illustrated in FIG. 1 as being a circular transport device, while in FIG. 6, the transport device 130 is shown as a linear transport device. Once again, the block 200 is described below in detail as being constructed to receive syringes; however, other drug delivery devices of multiple sizes can be received in such a block having the basic construction and features described herein. Moreover, any number of differently shaped transport systems, including irregular shaped devices, can be configured and constructed and are suitable for use. It will thus be appreciated that the syringe block 200 can be a separate part (such as an insert) relative to the transport device 130 in which case, the syringe block 200 is a modular unit that can be easily attached and removed (detachable), as well as interchanged, from the transport device 130. The syringe block 200 can be coupled to the transport device 130 using any number of conventional techniques, including the use of fasteners (e.g., a bolt), mechanical fits, such as a snap-fit arrangement, etc. This modular type design provides a number of advantages that are discussed below, including the ability to alter and change the type and capabilities of the blocks 200 from one production run to another production run. Alternatively, the syringe block 200 is an integral part (e.g., a machined part) of the transport device 130.

As shown in the generic top plan views of FIGS. 5 and 6, the syringe block 200 can be in the form of a structure that contains multiple positions for various sized syringes such that each syringe is isolated and spaced from the others. For example, the syringe block 200 can include at least two different positions for two different sized syringes and in particular, the illustrated syringe block 200 includes a first pocket 210 for receiving a syringe having a first size (S1); a second pocket 220 for receiving a syringe having a second size (S2), and a third pocket 230 for receiving a syringe having a third size (S3), with the three sizes (S1-3) being different from one another. The syringe block 200 is coupled to the transport device 130 such that the three pockets 210, 220, 230 face away from the transport device 130 and are open to receive syringes as well as have syringes removed at various stations surrounding the transport device 130. While FIG. 5 shows the pockets 210, 220, 230 aligned in a progressive manner relative to the syringe size (in order words from smallest to largest), this is merely one configuration and the largest size (S3) could be in the middle of (S1) and (S2).

It will also be appreciated that the syringe block 200 contains at least two syringe pockets that can receive and hold at least two different sized syringes; however, the syringe block 200 can have any number of different configurations than as shown in the drawings. For example and as described in greater detail below with reference to FIGS. 7-12, the syringe block 200 can have three or more pockets that are constructed to receive 2 different sized syringes and thus, at least two syringes are of the same size in this configuration. In addition, the syringe block 200 can be constructed to hold four syringes of different sizes (S1-4) and thus, have four different pockets sizes. Once again, the four syringes can be ordered sequentially according to their sizes or the syringes can be ordered randomly across the syringe block 200.

FIG. 6 illustrates a linear transport system or device 130 that moves linearly according to a predetermined track so as to move the syringes 10 according to a prescribed linear track or route. As with the circular transport device 130, the linear transport device 130 includes a predetermined number of syringe blocks 200 that are arranged around the device 130, with the pockets facing away from the syringe block 200 to receive syringes.

Figure 7:
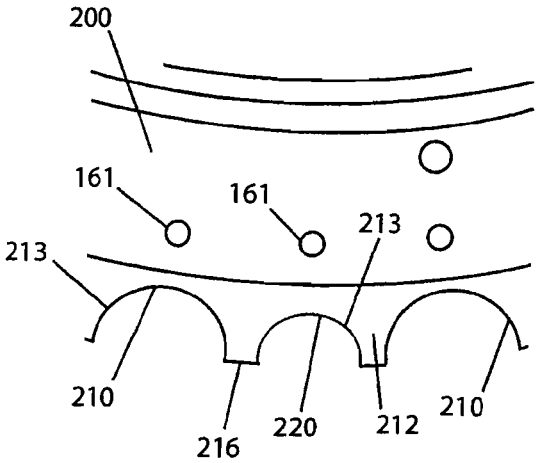
FIG. 7 is a top plan view of one syringe block that is constructed to accommodate syringes of two different sizes.
Figure 8:
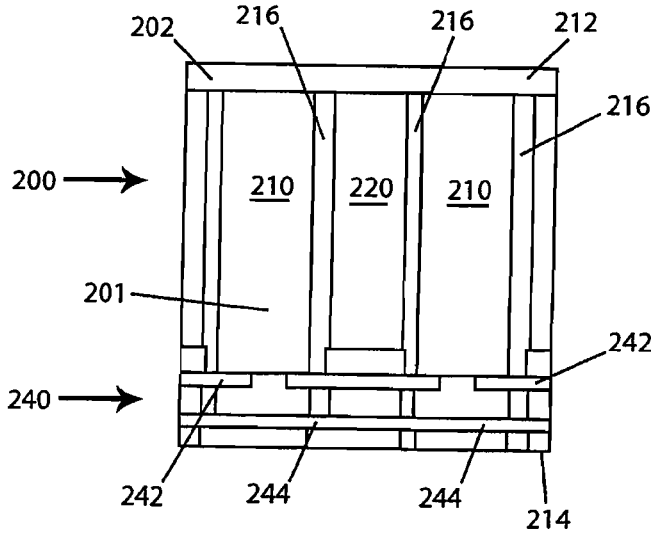
FIG. 8 is a side perspective view of the syringe block of FIG. 7.
Figure 9:
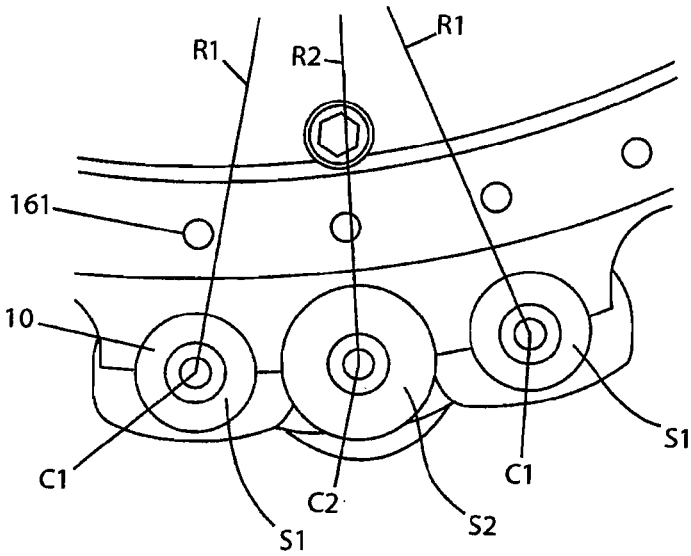
FIG. 9 is a top plan view of the syringe block of FIG. 5 with syringes of two different sizes being received and securely held therein.

FIGS. 7-9 illustrate one exemplary syringe block 200 that is configured to mate with and be coupled to or be an integral part of the transport device 130. As best shown in FIG. 8, the syringe block 200 is defined by a body 202 that has a number of preshaped pockets 210, 220, 230 for receiving and securely retaining syringes 10. In particular, the illustrated body 210 includes three pockets or compartments 210, 220, 230 that receive two different sized syringes 10, namely, a pair of syringes of a first size (S1) and one syringe of a second size (S2). In this exemplary orientation, the syringe (S2) is located between the pair of syringes (S1); however, the two syringes (S1) can be located next to each other. As used herein, two different sized syringes refers to syringes that have different volumes.

The body 202 includes a top edge defined by a top wall 212 and a rear edge defined by a bottom wall 214 as well as a number of vertical walls or dividers 216 that serve to partition and define the individual pockets 210, 220, 230 and separate the syringes from one another (S1) and (S2). The top wall 212 includes arcuate cutouts 213, in the form of semi-circular cutouts, that are constructed to receive and cradle an upper portion of the syringes (S1) and (S2). Since the syringes typically have cylindrically shapes barrels, the cutouts 213 are thus arcuate in nature in order to complement the barrels so as to nest or cradle the syringes (S1) and (S2). In addition, an inner surface 201 of the body 202 and in particular, an inner surface of each compartment or pockets 210, 220, and 230 has an arcuate shape (semi-circular) to complement the curved nature of the barrel, with the vertical partitions assisting in holding and retaining the syringes in the desired vertical positions.

The top wall 212 also preferably includes a number of features formed thereon, such as the posts 161 that are constructed to receive the removed tip caps of the syringes 10. In addition, the top wall 212 can include fasteners or the like to permit the block 200 to be securely yet removeably attached to the transport device 130.

Since the transport device 130 has a circular peripheral edge, an inner edge of the body 202 has an arcuate shape and thus, the pockets 210, 220, 230 are arranged about and circumferentially about the circular peripheral edge. In particular and as shown in FIG. 9, the pockets 210, 220, 230 are formed to have a specific relationship relative to the center point (C1) of circular transport device 130. More specifically, the pockets 210, 220, 230 are constructed such that when the syringes S1, S2, and S1 are received in the respective pockets, the distance between each of the center points (C2), (C3), and (C4) of the syringes S1, S2, and S1, respectively, and the center point (C1) of the device 130 is equal. In particular, a radius (R1) as measured from (C1) to (C2) and a radius (R2) as measured from (C1) to (C3) and a radius (R3) as measured from (C1) to (C3) are equal to one another to permit uniform processing of a syringe regardless of which pocket 210, 220, 230 the syringe is located in and regardless of the size of the syringe.

In the illustrated embodiment, the syringe (S2) is larger than the syringe (S1) and the shapes and specifications, e.g., depth, of the individual pockets 210, 220, 230 are configured so that the above relationship between the centers of the syringes and the center of the transport device 130 is realized.

In the case of using the linear transport device of FIG. 6, the centers of all of the luers of the syringes along one side of the device are axially aligned along a single line. This provides a similar result to having all of the radiuses R1, R2, and R3 equal to one another in the circular transport device embodiment of FIG. 1.

The syringe block 200 also includes a means 240 for retaining the syringes that is located at or near the bottom wall 214 of the body 202. The means 240 includes a first groove 242 and a second groove 244 that are formed in the body 202. The grooves 242 are linear in nature and are formed parallel to one another and spaced apart with the second groove 244 being formed closer to the bottom wall 214. The first groove segments 242 are thus contained in one horizontal plane, while the second groove 244 is contained in another horizontal plane.

Figure 10:
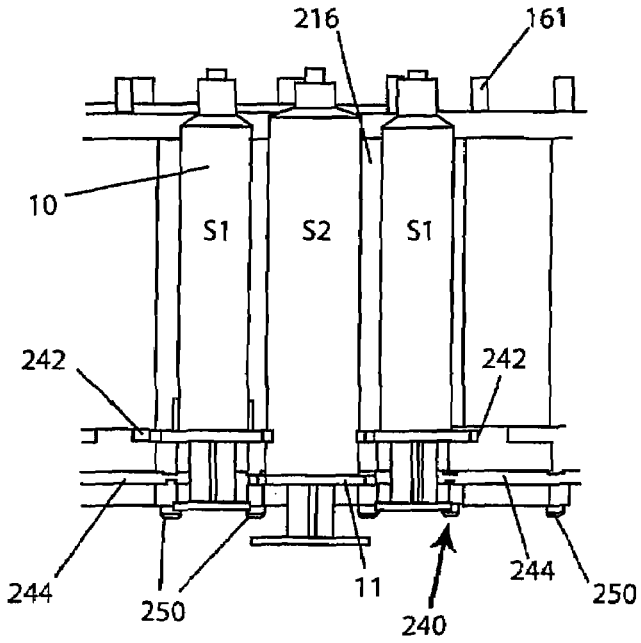
FIG. 10 is a side perspective view of the syringe block of FIG. 5 with syringes of two or more different sizes being received and securely held therein.
Figure 11:
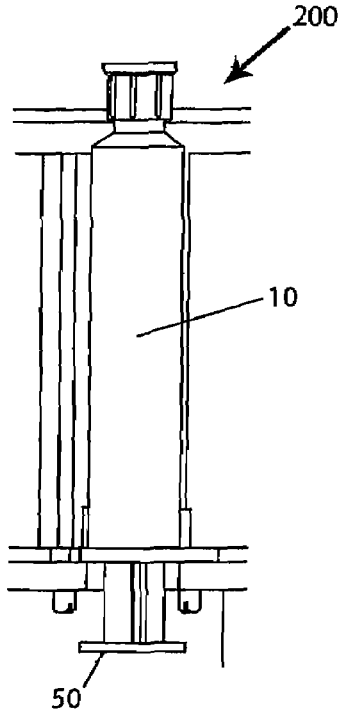
FIG. 11 is a local side perspective view of one syringe held in the syringe block of FIG. 5.
Figure 12:
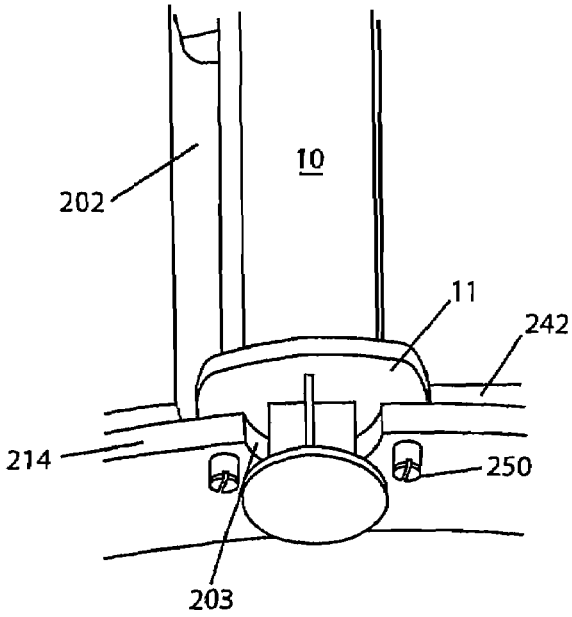
FIG. 12 is a local side perspective view of one exemplary means for retaining the syringe in the syringe block.

As illustrated, the second groove 244 can be a continuous groove that extends across all of the pockets 210, 220, 230, while the first groove 242 can be segmented in that it does not extend continuously across all of the pockets 210, 220, 230. The first and second grooves 242, 244 are constructed and sized to receive a flange 11 of each of the syringes 10 in order to position and assist in retaining and holding the syringes 10 in the respective pockets 210, 220, 230. Thus, the thickness of each of the grooves 242, 244 is complementary to the thickness of the flange 11 so that the flange 11 can be received into one of the grooves 242, 244 as illustrated in FIGS. 10-12. It will therefore be appreciated that the grooves 242, 244 act as locators or locating elements since the reception of the flange 11 within the groove 242, 244 ensures that the syringe 10 is in the proper upright orientation. The grooves 242, 244 extend outwardly from the inner compartment or area that receives and holds the syringe 10 since the flange 11 extends outwardly from the barrel of the syringe 10. The first and second grooves 242, 244 can be formed in the vertical partitions 216 since the flange 11 of the syringe 10 is fitted and received in the partitions.

It will also be appreciated that the number of differently spaced grooves will depend upon the number of different sized syringes that are received in the pockets. In other words, the embodiment of FIGS. 10-12 has two different grooves 242, 244 since there are two different sized syringes 10; however, if the syringe block 200 is constructed to receive three different sized syringes 10, then the syringe block 200 will contain three different grooves that are all spaced from one another and are contained in three different horizontal planes, with one flange of one syringe being received in one groove. The flanges 11 of the syringes 10 are thus positioned at different heights with respect to one another due to the differences in the sizes of the syringes.

The body 202 also includes a bottom arcuate cutout 203 that is similar to the upper cutout and is designed to receive and accommodate the syringe 10. The arcuate nature and the size of the cutout 203 are thus complementary to the barrel of the syringe 10 in order to accommodate the barrel of the syringe 10. The two arcuate cutouts thus accommodate and can assist in positioning the syringe 10 in the individual pockets 210, 220, 230.

In addition, the means 240 includes one or more retainers or tensioning elements 250 that provide a means for retaining one syringe 10 in one pocket 210, 220, 230. It will be appreciated that any number of different means can be used to help retain and hold the syringe 10 in place in its respective pocket 210, 220, 230. FIGS. 11 and 12 illustrate exemplary tensioning elements 250 in the form of spring loaded plungers (ball plungers) that apply a force against the syringe 10 and more particularly, the spring loaded plungers 250 apply a force against a localized area (circular point) on a surface or face of the flange 11 of the syringe 10. The applied force is in an upward direction and since the spring loaded plungers 250 extend through openings and into the grooves 242, 244 to permit the plungers 250 to come into contact with the surface or face of the flange 11. The spring loaded plungers 250 apply an upward force against the flange 11 and since the upward movement of the flange 11 is constrained by the top wall that defines the groove 242, 244. Thus, the spring loaded plungers 250 serve to pinch the flange 11 within the groove 242, 244 and against the top wall of the groove 242, 244 so as to hold and retain the syringe 10 in the pocket.

While the spring-loaded plungers 250 serve as one type of retaining means, other types of means can be used including vacuum means. In other words, the pockets 210, 220, 230 can have vacuum means associated therewith and when actuated, the vacuum means applies a vacuum (generates negative pressure) to the location where the syringe 10 is contained and is of sufficient strength so as to hold the syringe 10 in place in the pocket 210, 220, 230.

In another aspect of the present invention, the different grooves are formed in the body 202 of the block 200 at predetermined locations and in view of the sizes of the syringes 10 that are received within the pockets such that the luer heights of all of the syringes is at least approximately the same. In other words, when the different sized syringes, such as syringes (S1), (S2), (S3), are received in the pockets 210, 220, 230, the ends of the luer fittings (luers) are all aligned with one another so as to lie in a single plane. This permits the entire system 100 to be successfully indexed and integrated, as described below, so that when the transport device 130 is operated and advances the syringe block 200 a prescribed distance, any one of the syringes (e.g., S1, S2, or S3) in the respective pockets 210, 220, 230 can be uniformly aligned with another device, such as the fluid transfer device, to permit an operation to be performed on the target syringe S1, S2, or S3. By having the luer heights and location of the luer ends constant and uniform, the positional indexing and encoder technology of the present invention are made possible.

It will be appreciated that when the syringe blocks 200 are of the type that are removable or disengageable from the transport device 130, the transport device 130 can easily be reconfigured from one product line operation to another product line operation or it is also possible that the transport device 130 can be reconfigured for one product line. In other words, the transport device 130 does not necessarily have to have syringe blocks 200 of the same type but can include two or more different types of syringe blocks 200. For example, one or more syringe blocks 200 can be of the type that are constructed to receive and hold three different sized syringes (S1), (S2) and (S3) and one or more other syringe blocks 200 can be used and are of the type that are constructed to receive and hold two different sized syringes, such as (S1), (S2) or another pair of syringes (S4), (S5).

As previously mentioned, the transport device 130 is supported by absolute encoder technology and therefore, the master controller is programmed to move the transport device 130 in an indexed manner in that one syringe block 200 is advanced one increment, which typically is from one station to another station. This can be referred to as indexing from block position to block position. However, the system 100 is also configured so that partial indexing within the block 200 for syringe size adjustment. More specifically, if the syringe block 200 is of the type shown in FIG. 9 and contains at least one S1 sized syringe 10 and one S2 sized syringe 10, the positional indexing features of the present invention, including the design of the master controller, can be arranged so that initially the master controller advances the S1 syringe from one station to a next station where the S1 syringe is in the correct location to be further processed, e.g., a tip cap removed or placed thereon or medication being delivered therein; however, the adjacent S2 syringe at this next station is not in the proper position for further processing (e.g., the tip cap can not be removed from S2). In order to position the S2 syringe within this next station so that it can be processed (e.g., have its tip cap removed), the master controller recognizes the presence of the S2 syringe within the block 200 and after the processing of the S1 syringe is complete, the master controller moves the transport device 130 a predetermined incremental amount in order to position the S2 syringe at a target location within the particular station so that an operation can be performed on the S2 syringe.

This is an easy operation since the distances between the S1 location and S2 location on the syringe block 200 are known and therefore, the master controller simply instructs the transport device 130 to move incrementally in one direction in order to position the S2 syringe in the target location. In the case where there are more than two different sized syringes within the syringe block 200, the master controller can be configured to initially perform all operations with respect to syringes of one size (e.g., S1 syringe) and then make incremental adjustments (partial indexing) in order to perform the operations with respect to the other syringes (e.g., S2 and S3 syringes). For example, the master controller can be configured to perform all S1 actions first, such that each time the transport device 130 is advanced, the S1 syringe location in the syringe block 200 is delivered to the target position at the next station to permit further processing of the S1 syringe. After all S1 syringe actions are performed at all of the stations, the transport device 130 is then moved a first incremental distance in one direction to cause all S2 syringes to be moved into the target locations at each of the stations (thereby displacing the S1 syringes from this location) and then after all S2 syringe actions have been performed, the transport device 130 is moved a second incremental distance to cause all S3 syringes to be moved into the target locations at each station; and this process continues until all of the different sized syringes are processed. Then, the further indexing from block position to block position occurs.

Since the user initially instructs the master controller (or the master controller is instructed as by the presence of RFID tag 20) as to the overall number of syringes, as well as to the number of different types of syringes, and the location of the various syringes, the master controller has a detailed record as to the precise locations of all of the syringes and the characteristics or properties, such as size, of the syringes. It will be appreciated that not all of the pockets of the syringe block 200 contain a syringe and some syringe blocks may not contain any syringes. Thus, any number of different syringe orders or patterns can be formed about the transport device. For example, four consecutive syringe blocks 200 can contain only S1 syringes and then the fifth syringe block 200 can contain both S1 and S2 syringes and then the sixth through eighth blocks 200 can contain only S1 syringes before the ninth block 200 contains S1-S3 syringes. The master controller tracks the positions of all of these different syringes and advances the transport device 130 from station to station (indexing from block position to block position) and makes the necessary incremental adjustments (partial indexing) within the block 200 for syringe size adjustment resulting in all of the multiple sized syringes being properly processed at one particular station. It will therefore be appreciated that the indexing and encoder technology that tracks the position of the transport device 130 and the syringe blocks 200 perform two separate operations, namely, a main indexing from block position to block position and a secondary indexing in the form of partial indexing within the block for syringe size adjustment.

It will also be appreciated that as previously mentioned, the limitation that R1, R2, and R3 be equal and that the luer height is the same permit both the main indexing and secondary indexing to be possible and to have a high degree of precision so that any number of desired operations can be performed on the syringe.

It will also be understood that the system 100 is configured to receive, handle and process both bandoliered drug delivery devices (syringes) and loose, non-bandoliered syringes. When the syringes are bandoliered, they are properly spaced along the carrying web and in the case where multiple sized syringes are used, the different sized syringes are ordered and spaced along the carrying web. For example, if three different sized syringes are to be received in each syringe block 200, the carrier/web contains groups of syringes S1-S3, with sufficient spacing between the groups such that when one group is disposed in one syringe block 200, the other group will be disposed in the other syringe block 200. In other words, the spacing of the syringe groups allows each group to be received into their respective pockets and permits unrestricted movement of the transport device 130.

It will be appreciated by persons skilled in the art that the present invention is not limited to the embodiments described thus far with reference to the accompanying drawings; rather the present invention is limited only by the following claims.

What is claimed is:

1. An automated medication preparation system including a number of stations including a station having an automated device for preparing and delivering a dosage of medication to a syringe comprising:

an automated transport device for controllably delivering each syringe from one location to another location;

a plurality of syringe blocks formed along the periphery of the automated transport device, each syringe block includes at least a first pre-shaped pocket and a second pre-shaped pocket for receiving and retaining at least two differently sized syringes, that have different volumes, according to a predetermined orientation, the first and second pre-shaped pockets being formed side-by-side within the loading site; and a controller in communication with the automated transport device for moving the automated transport device in an indexed manner; wherein each syringe includes a readable/rewritable medium fixed thereto that contains at least a first set of information that identifies the type of syringe to which the readable/rewritable medium is coupled to, whereby by reading the readable/rewritable media fixed to the syringes, the controller identifies the overall number of syringes, as well as the number of different types of syringes and the locations of the syringes, wherein the controller tracks positions of all the syringes and advances the transport device from station to station and makes any necessary incremental adjustments with respect to the advancement of the transport device to cause all of the first and second syringes to be processed at any one particular station.

2. The system of claim 1, wherein the readable/rewritable medium comprises an RFID tag and the first set of information includes a volume of the syringe.

3. The system of claim 2, wherein the RFID tag includes a second set of information that includes dosage information that identifies a product identifier that identifies the medication, a volume of the dosage, and a concentration of the dosage.

4. The system of claim 2, wherein the RFID tag includes dosage instructions and the system includes an RF reader or RF reader/writer that communicates with the RFID tag and with the controller so that information including the dosage instructions from the RFID tag are communicated to the controller.

5. The system of claim 4, wherein the dosage instructions are sent to a fluid transfer device which in turn prepares the dosage of medication based on the dosage instructions.

6. The system of claim 2, further including an RF reader or RF reader/writer that communicates with the REID tag and with the controller so that the first set of information is communicated to the controller and the presence of the syringe in one respective pocket of the syringe receiving member is stored by the controller so as to permit the controller to track the syringe as the transport device is advanced in the indexed manner.

7. An automated medication preparation system including an automated device for preparing and delivering a dosage of medication to a syringe comprising:

an automated transport device for controllably delivering each syringe from one location to another location, the automated transport device including a plurality of syringe loading sites located, in a spaced manner, along a periphery of the automated transport device, each syringe loading site including at least two different, pre-shaped pockets located side-by-side for receiving and retaining at least two differently sized syringes, that have different volumes, according to a predetermined orientation such that a fixed relationship exists between a center of each syringe and a point of the transport device regardless of which pocket the syringe is disposed in and distal tips of the syringes are contained in the same horizontal plane; and a controller in communication with the automated transport device for moving the automated transport according to a first indexing movement and a different second indexing movement, the first indexing movement causing one syringe block to be moved from one station to another station, while the second indexing movement is a partial indexing movement within the syringe block for making incremental syringe size adjustments at one select station so at to position one of the pockets at a target location to permit an operation to be performed on the respective syringe at the one station.

8. The system of claim 7, wherein the syringe block is separate from the transport device and is detachably coupled thereto.

9. The system of claim 7, wherein the pockets are separated from one another by vertical divider walls and each pocket is defined by an arcuate space that receives at least a portion of one syringe and the syringe block includes a plurality of locating features for positioning each syringe in one respective pocket, the locating features being formed so that when the syringes mate with the locating features such that the distal tips lie in the same horizontal plane.

10. The system of claim 7, wherein the syringe block has a pair of first pockets for receiving syringes having a first size and a second pocket for receiving one syringe having a second size.

11. The system of claim 7, wherein the syringe block contains at least three pockets for receiving three different sized syringes.

12. The system of claim 11, wherein each sized syringe has its own respective locating feature formed in the syringe block at a different location compared to the other locating features.

13. The system of claim 7, wherein the syringes are part of a bandoliered structure with the syringes being grouped along and attached to a web to permit the syringes to be received in different syringe blocks that are spaced apart from one another.

14. An automated medication preparation system including a plurality of stations including one that includes automated preparation and delivery of a dosage of medication to a drug delivery device comprising:

an automated transport device for controllably delivering each drug delivery device from one location to another location, the automated transport device having a plurality of syringe blocks that are spaced apart from one another along a periphery of the automated transport device, wherein each syringe block includes at least two pre-shaped pockets for receiving and retaining at least two differently sized drug delivery devices according to a predetermined orientation, the differently sized drug delivery devices having different volumes and the at least two pre-shaped pockets having different constructions from one another and being formed side-by-side; and a controller in communication with the automated transport device for moving the automated transport device in an indexed manner such that one syringe loading site is advanced into one given station at a time.

15. An automated medication preparation system including automated preparation and delivery of a dosage of medication to a syringe comprising:

an automated transport device for controllably delivering each syringe from one location to another location;

a plurality of syringe loading sites located along a perimeter of the automated transport device, each syringe loading site including a first pre-shaped pocket for receiving and retaining a first syringe and a second pre-shaped pocket for receiving and retaining a second syringe that has a different size and different volume compared to the first syringe, the first and second pre-shaped pockets being located side-by-side within the syringe loading site; and a controller in communication with the automated transport device for moving the automated transport device in an indexed manner, wherein the controller is configured to operate in one mode where the automated transport device is advanced in an indexed manner such that the first syringes are advanced to target locations at the stations where operations are performed only on the first syringes and after all operations are performed on all first syringes at the stations, the controller instructs the automated transport device to advance in an indexed manner such that the second syringes are advanced to the target locations at the stations where operations are performed only on the second syringes.

* * * * *